US006198062B1

(12) United States Patent
Mather et al.

(10) Patent No.: US 6,198,062 B1
(45) Date of Patent: Mar. 6, 2001

(54) MODULAR, HIGH-VOLTAGE, THREE PHASE RECLOSER ASSEMBLY

(75) Inventors: Brian D. Mather, North Olmsted; Edward A. Steele, Rocky River, both of OH (US)

(73) Assignee: Joslyn Hi-Voltage Corporation, Cleveland, OH (US)

( * ) Notice: Subject to any disclaimer, the term of this patent is extended or adjusted under 35 U.S.C. 154(b) by 0 days.

(21) Appl. No.: 09/313,012

(22) Filed: May 17, 1999

(51) Int. Cl.[7] ..... H01H 33/02; H01H 33/42
(52) U.S. Cl. ..... 218/152; 218/120; 218/154
(58) Field of Search ..... 218/120, 140, 218/152, 153, 154, 7, 14, 84, 9; 361/10, 72; 335/8–10; 200/307

(56) References Cited

U.S. PATENT DOCUMENTS

| | | | | |
|---|---|---|---|---|
| 4,184,186 | * | 1/1980 | Barkan | 361/10 |
| 4,568,804 | | 2/1986 | Luehring | 218/138 |
| 4,797,777 | * | 1/1989 | Beard | 218/154 X |
| 4,855,862 | * | 8/1989 | Wainio et al. | 361/72 |
| 5,091,616 | * | 2/1992 | Ramos et al. | 218/9 |
| 5,387,771 | | 2/1995 | Luehring | 218/129 |
| 5,600,112 | * | 2/1997 | Opfer | 218/154 |
| 5,834,725 | * | 11/1998 | Clarke et al. | 218/120 |
| 5,912,604 | * | 6/1999 | Harvey et al. | 335/9 |

OTHER PUBLICATIONS

Six page product brochure published by Joslyn Hi–Voltage Corporation entitled "Electronically–Controlled Vacuum Reclosers", publication date Oct. 1997.

Five page product brochure published by Cooper Power Systems entitled "The Kyle® Nova Recloser". To the best of Applicants' knowledge the aforementioned product brochure was published prior to May 17, 1998, that is, more than one year prior to the filing date of the above–identified patent application.

Two page product brochure published by ABB (Asea Brown Boveri) Distribution Automation Equipment Division entitled "VR–3S Recloser". To the best of Applicants' knowledge the aforementioned product brochure was published prior to May 17, 1998, that is, more than one year prior to the filing date of the above–identified patent application.

* cited by examiner

*Primary Examiner*—J. R. Scott
(74) *Attorney, Agent, or Firm*—Watts, Hoffmann, Fisher & Heinke, Co., L.P.A.

(57) ABSTRACT

In accordance with the present invention, a recloser assembly including three modular recloser units operating under the control of a controller. The recloser units are interchangeable and are suitable for use in a three phase power distribution system where three phase tripping is desired or each recloser unit may be operated independently as in a single phase power distribution system. For use in a three phase system, a gang rod mechanically couples pivoting actuation levers extending from a solenoid switching assembly of each of the recloser units. The gang rod insures that all three switching assemblies open and close in unison, thus, each power is transmitted by all three recloser units or power is not transmitted by any of the three recloser units. For single phase power distribution operation, the gang rod is removed and the recloser units operate independently. Each recloser unit includes a cube shaped base, a tapered cylindrical support affixed to an upper surface of the base. The support includes an opening to receive a ceramic insulator supporting a switch terminal and a second threaded opening to receive a bushing and polymer insulator supporting a line terminal. Each recloser unit utilizes a vacuum interrupter switch or terminal contact assembly to contain electrical arcing and maximize terminal contact life. The interior region defined by each support is filled with an environmentally friendly, nonvolatile insulation material. An interior region of each base houses a solenoid switch assembly and a pressure equalization assembly.

29 Claims, 11 Drawing Sheets

MODULAR, HIGH-VOLTAGE, THREE PHASE RECLOSER ASSEMBLY

FIELD OF THE INVENTION

The present invention relates generally to a modular, high-voltage, vacuum-type recloser assembly operable in a three phase or a single phase mode and, more particularly, to a high-voltage, vacuum-type recloser utilizing modular construction of each of three independent recloser units thereby providing interchangability of the recloser units and facilitating adaption of the recloser assembly to operate as a single three phase recloser or as three independent one phase recloser units.

BACKGROUND OF THE INVENTION

High-voltage, three phase recloser assemblies (also referred to as reclosing relays) are used in three phase electric power distribution networks to provide for circuit breaking of electrical power when an overcurrent condition is sensed on any one of the three power transmission lines coupled to the recloser assembly. Typical voltage rating of such recloser assemblies range from 15 kilovolts (kV) to 38 kV and an interrupting current rating of up to 12,600 amps. A controller is electrically coupled to three solenoid actuated switching assemblies of the recloser assembly. When an overcurrent condition on a transmission line is sensed by a controller electrically coupled to the recloser assembly, controller causes the recloser assembly to open the three switching assemblies, each switching assembly being coupled to a different one of the three power lines. Each of the three switching assemblies includes a line terminal and a switch terminal coupled in series with a power transmission line. Tripping or opening a recloser switching assembly causes an open circuit condition between the line and switch terminals and interrupts the supply of power on that power transmission line. After a predetermined time, the controller sends electrical signals to the recloser switching assembly causing the solenoid switch to close and resuming power transmission through the switching assembly. The controller continually monitors for overcurrent conditions on the power transmission lines.

A prior art three phase recloser assembly is shown in FIGS. 1 and 2 at 50. As can be seen in FIG. 2, the recloser assembly 50 is typically mounted on a utility pole 85. A controller monitors currents through the recloser assembly terminals and opens the three recloser switching assemblies when an overcurrent condition is sensed on one or more of the power transmission lines. Typically, current through the terminals is sensed via three current transformers (CTs), one CT positioned coaxial to each of the three line terminals 52, 60, 68. The controller 90 is typically mounted on the pole 85 at a lower height above ground so as to be accessible to a technician standing on the ground. The controller 90 and recloser assembly 50 are electrically coupled by a cable 92. FIG. 1 shows a prior art vacuum type recloser assembly 50 manufactured by Joslyn Hi-Voltage Corporation, Cleveland Ohio 44105, the assignee of the present invention.

The recloser assembly 50 includes a tank 80, at ground potential, and three sets of terminals 52, 56, 60, 64, 68, 72. The first set of terminals 52 (line terminal), 56 (switch terminal) provide for a circuit breaker connection for a first power distribution line (first phase of a three phase distribution network). The second set of terminals 60, 64 provide for a circuit breaker connection for a second power line (second phase of the three phase network) and a the third set of terminals 68, 72 provide for a circuit breaker connection for a third power line (third phase of the three phase network). Air bushings 54, 58, 62, 66, 70, 74 insulate respective terminals 52, 56, 60, 64, 68, 72 from the tank 80. The tank 80 is filled with an dielectric insulating gas such as sulfur hexafluoride, $SF_6$, or oil and is held at ground potential.

Three vacuum interrupter switch contact assemblies provide the circuit beaker connection between the first set of terminals, the second set of terminals and the third set of terminals. A suitable vacuum interrupter assembly is disclosed in U.S. Pat. No. 5,387,771 to Luehring issued Feb. 7, 1995, entitled "Axial Magnetic Field High Voltage Vacuum Interrupter" and assigned to the assignee of the present invention. U.S. Pat. No. 5,387,771 is incorporated herein in its entirety by reference.

Prior art three phase recloser assemblies were characterized by long assembly times and numerous switching components. Also, use of sulfur hexafluoride, $SF_6$ as an insulating material in the tank was less than desirable because of environmental concerns. Additionally, the recloser assembly could not easily be changed to accommodate single phase operation.

What is needed is an improved three phase recloser assembly that is more efficient to assemble than current art reclosers and has less switching components. What is also needed is a recloser that uses a more environmentally friendly insulating material. What is also needed is a recloser that can easily be adapted for three phase or single phase operation.

SUMMARY OF THE INVENTION

The present invention concerns a high voltage, modular recloser assembly which is operable in either a three phase mode or a one phase mode. The recloser assembly includes three modular recloser units each supporting a solenoid switching assembly electrically coupled between a line terminal and a switch terminal. A moveable switch contact, electrically coupled to the line terminal, and a stationary contact, electrically coupled to the switch terminal are disposed in an evacuated casing. Each of the switching assemblies is actuated by a solenoid switch. In the three phase mode of operation, the switching assemblies of each recloser are mechanically coupled or ganged so that the switching assembly are required to move in unison. For example, if an overcurrent condition is sensed on any one of three power transmission lines, all three solenoid switches will be tripped or opened thereby interrupting power on all three power transmission lines. Since the switching assemblies always must move in unison because of the mechanical coupling of the switches, a situation is prevented wherein one switch is in one position (open or closed) and the other two switches are in a different position. A situation in which one of the switching assemblies is in a different position that the other two switching position is undesirable. For example, if one switch were to be in the closed position and the other two switches were in the open position, one phase power would be transmitted along the transmission lines to a customer's power equipment requiring three phase power. Such a situation would likely cause damage to customer's equipment.

To permit one phase operation of the recloser assembly, the mechanical coupling of the switching assemblies is removed and the units operate independently (under the control of appropriate controllers) for single phase power control. Furthermore, the recloser assembly is comprised of three mechanically coupled recloser units. Each of the recloser units can be separated, if desired, and used as a stand-alone vacuum recloser device (operating under the control of an appropriate controller). For example a single unit could be mounted on a utility pole (stand alone configuration). Alternately, the recloser assembly could be mounted on a utility pole in a unitary configuration (all three recloser units mechanically coupled) or in a spread configuration wherein the three recloser units are mechanically separated, and mounted, for example, at 90 degree angles or 120 degree angles with respect to each other. As is evident, the versatility of the recloser assembly of the present invention in both operating modes (three phase and one phase) and in mounting configurations (unitary, spread and stand alone mounting) represent significant advantages over prior reclosers.

Each recloser unit includes a cast aluminum, generally cubic-shaped base defining an interior region in which a solenoid switch of the switching assembly is disposed. Extending upwardly from the base is a hollow, cast aluminum support. The support is bolted to the base and includes top, bottom and side openings. A ceramic insulator is inserted in the top opening of the support. The ceramic insulator is hollow and supports the switch terminal and a stationary contact extending downwardly from the switch terminal. A line terminal is supported in a line terminal assembly that includes a bushing that is mounted to the support and a polymer insulator. The polymer insulator could also, if desired, be ceramic. The bushing supports a disk shaped current transformer which abuts a center flange of the bushing. An operating rod-which is mechanically coupled to a movable contact at its distal end, extends upwardly from a solenoid switching assembly. The movable contact is electrically coupled to the line terminal. When the solenoid switch is in one position (the closed position), the movable contact makes contact with the switch terminal stationary contact thereby providing a conductive path between the line and switch terminals. When the solenoid switch is in its second position (the open position), the movable contact is spaced apart from the switch terminal stationary conduct thereby opening the circuit between the line and switch terminals.

The recloser assembly includes three recloser units that are removably mechanically fastened via tie rods which extend horizontally between the center recloser unit and the outer recloser units. Four tie rods extend from the middle recloser unit through the base of one of the outer recloser units to fasten these two recloser units together and four tie rods extend between the middle recloser unit and the other of the outer recloser units to fasten these recloser units together. The bases have open sides forming an open interior region. Sandwiched between the intersection of outer recloser unit bases and the middle recloser unit is a u-shaped mounting bracket for mounting the recloser assembly to a utility pole.

The recloser assembly of the present invention includes a novel mechanical coupling assembly for three phase tripping of the switching assemblies and also permits independent single phase operation. If the recloser assembly is to be used in a three phase operation, a ¼" by 1" gang rod is pinned to a pivoting lever of each of the solenoid switching assemblies. The gang rod moves horizontally between two positions. In one position of the gang rod, the pivoting levers are in a position corresponding to the solenoid switches being closed and all of the switch terminals are electrically coupled to their corresponding line terminals. In the second position of the gang rod, the pivoting levers are in a position corresponding to the solenoid switches being open and all of the switch terminals being disconnected from their corresponding line terminals. An overload current condition on any one of the three power lines coupled to the recloser assembly causes all three recloser assembly switching assemblies to open (this is referred to as three phase tripping). If the recloser units are to be used for individual single phase operation, the gang rod is removed from the pivoting levers and each recloser unit is independently operable as a independent recloser unit. And, as noted above, the recloser units themselves can be configured for mounting in a stand alone configuration (one recloser unit mounted on a utility pole), spread configuration (three recloser units mechanically disconnected and mounted in spaced apart orientations on a utility pole), and unitary configuration (three recloser units mechanically connected).

An interior region of each recloser unit support is filled with polyurethane foam which functions as a dielectric insulating material. In the recloser assembly of the present invention, the recloser bases and upright supports are at ground potential. This is an advantageous since the current transformer attached to the line terminal bushing needs to be at ground potential. If the base and support were not at ground it would be necessary to provide a separate line to ground connection and an insulation surrounding the connection.

The recloser assembly of the present invention includes novel pressure equalization assembly. A bladder is supported within a bladder compartment of the interior region of each base to equalize pressure between the interior region and the outside environment. The bladder compartment has holes providing fluid communication between the base interior region and the bladder interior. An exterior wall of the base adjacent the bladder includes an opening covered by a blow out plate. The bladder functions to equalize pressure between the base interior pressure and the outside pressure. If the pressure inside the base interior region was significantly less that the outside environmental pressure, moisture could be drawn into the base interior region thereby corroding the solenoid switching assemblies. If the pressure inside the base was much greater than the outside pressure (e.g., from short circuit condition across the recloser assembly), a catastrophic failure (explosion) of the base could occur. Instead, with increasing pressure in the base interior, the bladder expands and displaces the blow out plate to equalize pressure and avoid catastrophic failure of the recloser assembly. A packet of desiccant is placed inside the base interior region to minimize moisture present in the base interior region due to condensation. The volume encompassed by the recloser unit interior regions (including the three pressure equalization assemblies, one located in each recloser unit base) constitute a closed system and a sealed unit with respect to the outside environment.

These and other objects, features and advantages of the invention will become better understood from the detailed description of the preferred embodiments of the invention which are described in conjunction with the accompanying drawings.

DETAILED DESCRIPTION

Figures 3, 4:
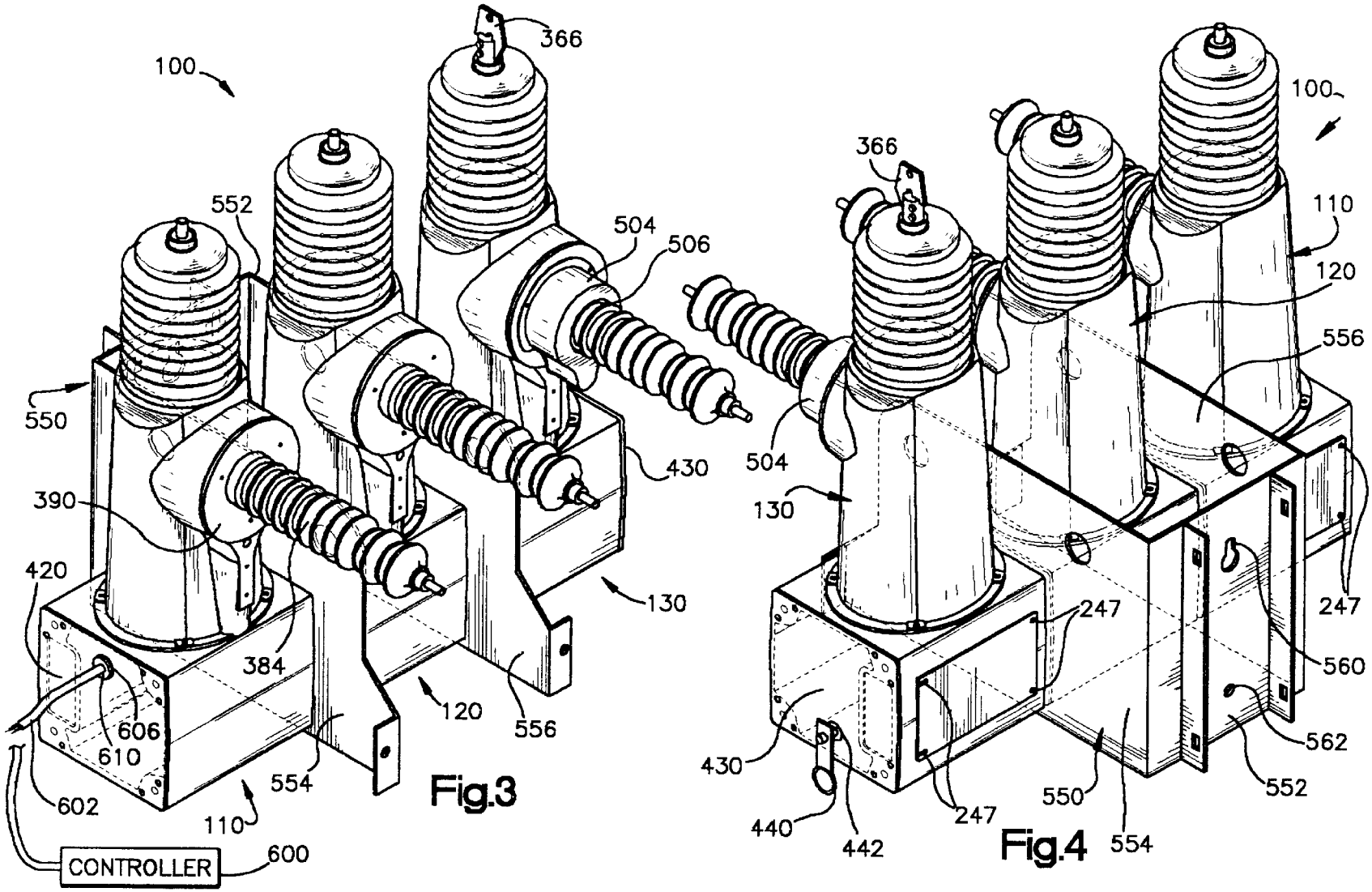
FIG. 3 is a front perspective view of a recloser assembly of the present invention.
FIG. 4 is a back perspective view of a recloser assembly of the recloser assembly of FIG. 3.
Figure 5:
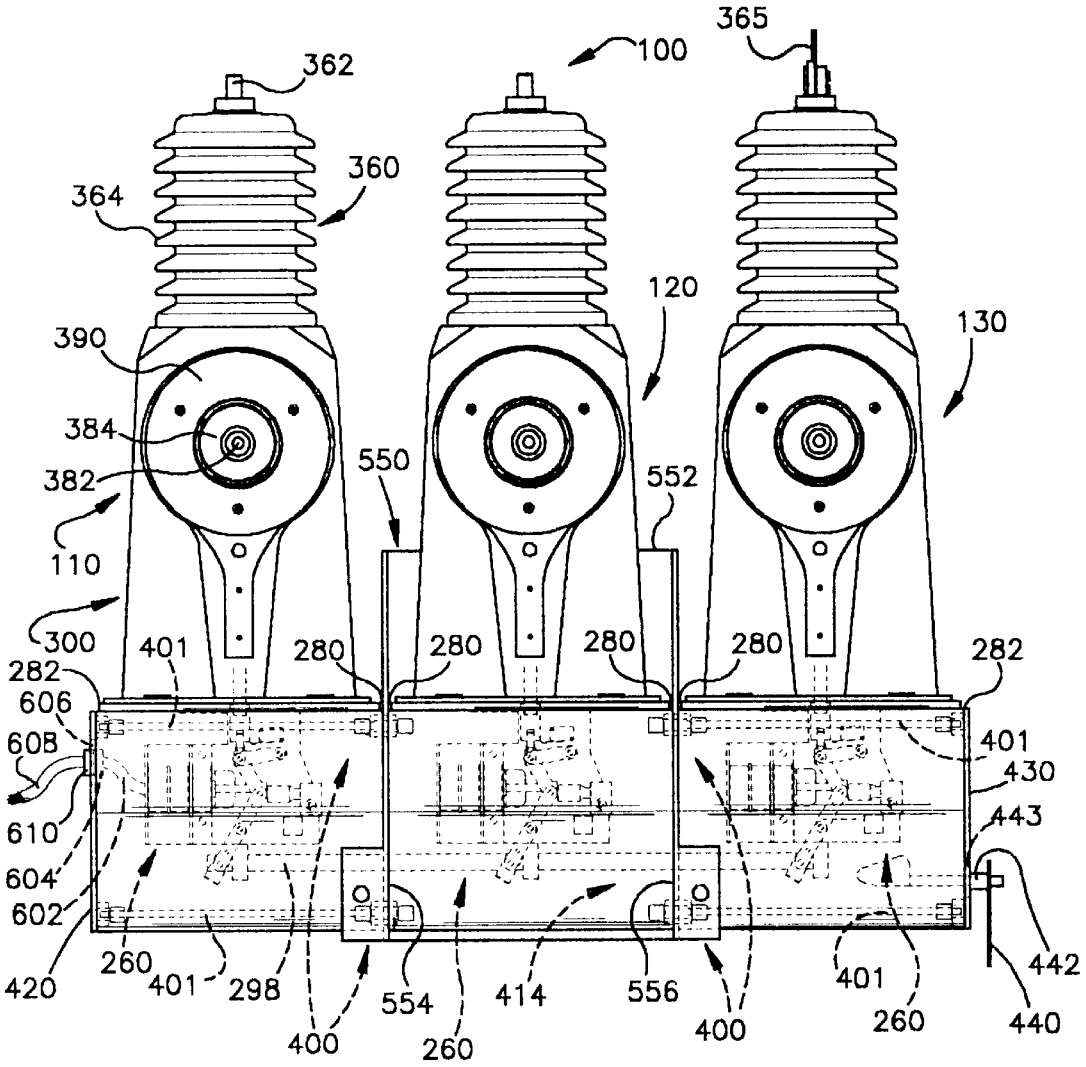
FIG. 5 is a front elevation view of the recloser assembly of FIG. 3.

Turning to the drawings, a three phase, vacuum type recloser assembly is shown generally at 100 in FIGS. 3–5. The recloser assembly 100 is typically used in three phase power distribution systems for intermittent power interruption (tripping) when an overcurrent condition is sensed on one of the power distribution lines. The recloser assembly 100 is designed for up to 38 kilovolt (kV) power applications and in excess of 12,500 amps (A) of current capacity.

Figure 2:
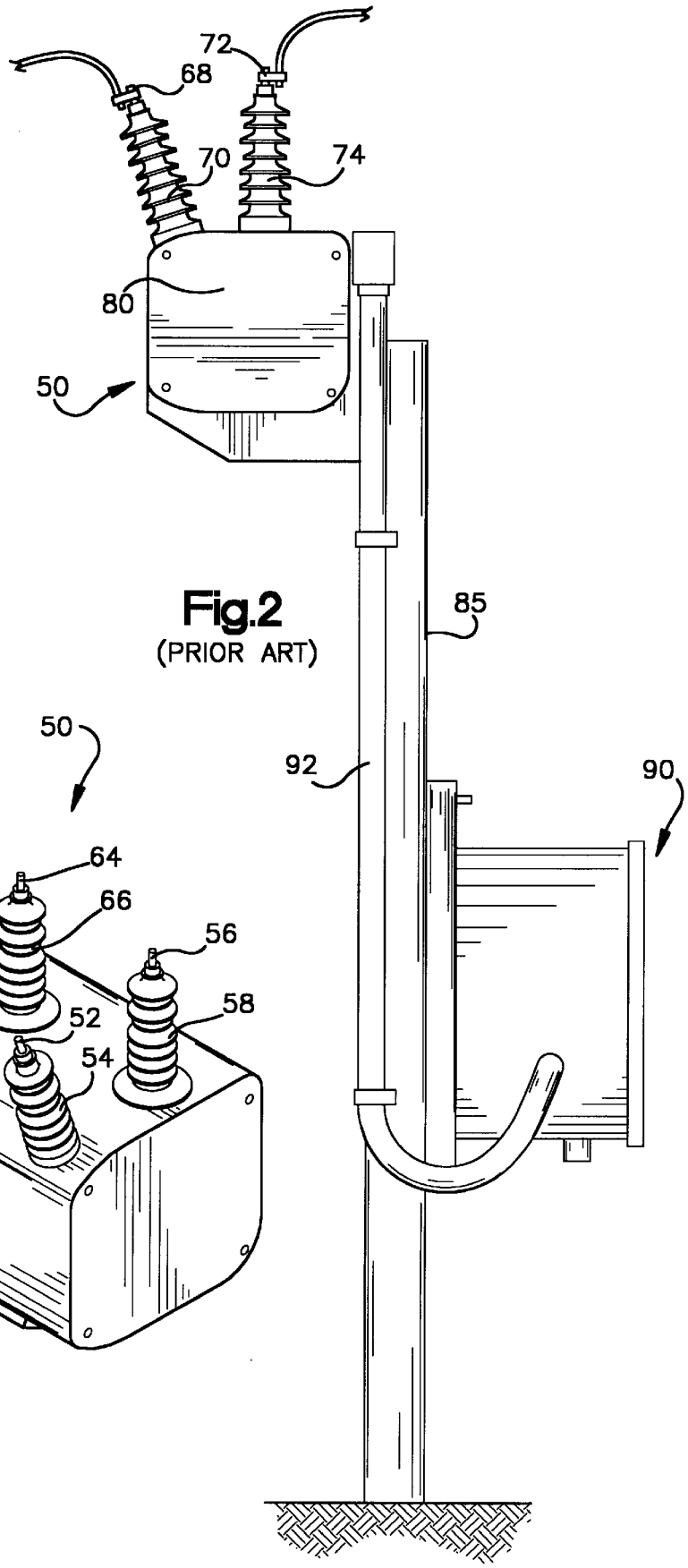
Fig.2 (PRIOR ART)
FIG. 2 is a schematic view of the prior art recloser assembly of FIG. 1 mounted on a pole.
Figure 1:
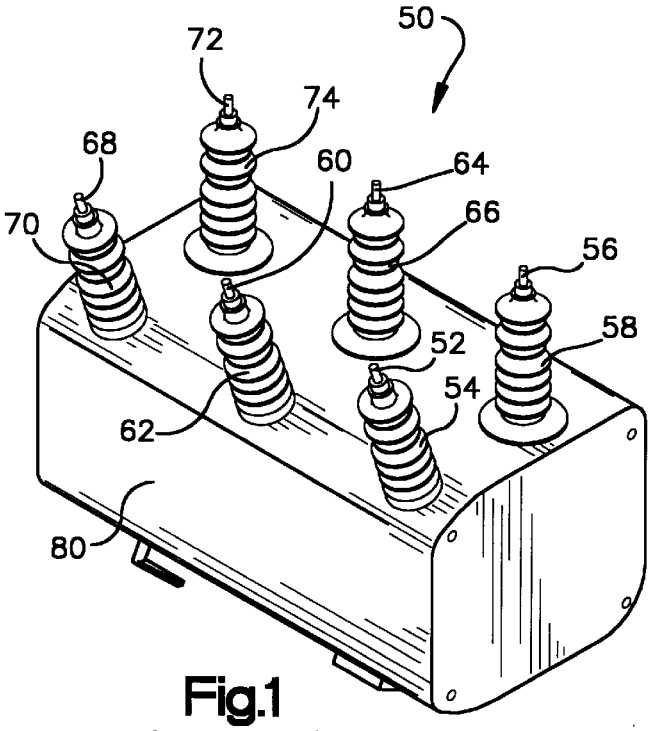
Fig.1 (PRIOR ART)
FIG. 1 is a schematic view of a prior art recloser assembly.

The recloser assembly 100 operates under the control of a controller (schematically shown as 600 in FIG. 3) which monitors current conditions on the power distribution lines and determines when the three switching assemblies 260 (FIGS. 5 and 6) should be open or closed. A suitable controller for the controller assembly 100 of the present invention is the FAULTMASTER 2500 controller sold by the assignee of the present invention, Joslyn Hi-Voltage Corporation of Cleveland, Ohio 44105. Typically the recloser assembly 100 is mounted on a utility pole utilizing the mounting bracket 550 and the controller (shown schematically at 600 in FIG. 3), disposed within an appropriate housing, is mounted on the pole at a lower height so as to be accessible by a service technician standing on the ground. An electrical cable routes data and control signals between the controller 600 and the recloser assembly solenoid switching assemblies 260. The prior art recloser assembly 50 shown in FIG. 2 illustrates a typical arrangement of a recloser assembly and controller mounted on a utility pole.

The recloser assembly 100 of the present invention differs from prior art reclosers in that it is comprised of three modular, interchangeable recloser units, 110, 120, 130 (FIGS. 3–5). Each recloser unit is identical in design and construction. Thus, should one of the recloser units 110, 120, 130 fail, it may be replaced without replacing the entire assembly 100. Moreover, the recloser assembly 100 is convertible between being used in three phase power distribution systems to effect three phase tripping (that is, all recloser unit switching assemblies 260 open when an overcurrent condition is sensed on any of the three power distribution lines) and use as three independent reclosers in a single phase power distribution system. In a three phase power distribution system, one recloser unit is coupled to each of the three power lines. Each different power line transmits one phase of the three phases of the distribution system.

Figure 7:
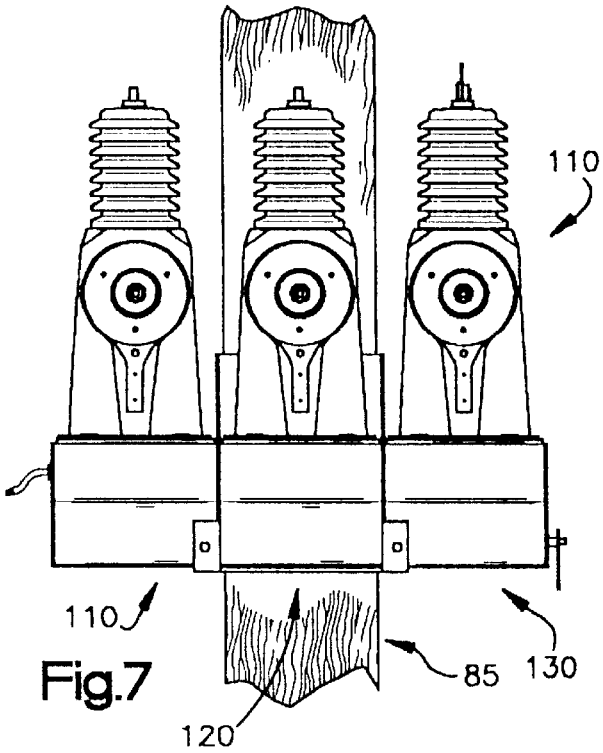
FIG. 7 is a front elevation view of the recloser assembly of FIG. 3 mounted on a utility pole in a unitary configuration.
Figure 8:
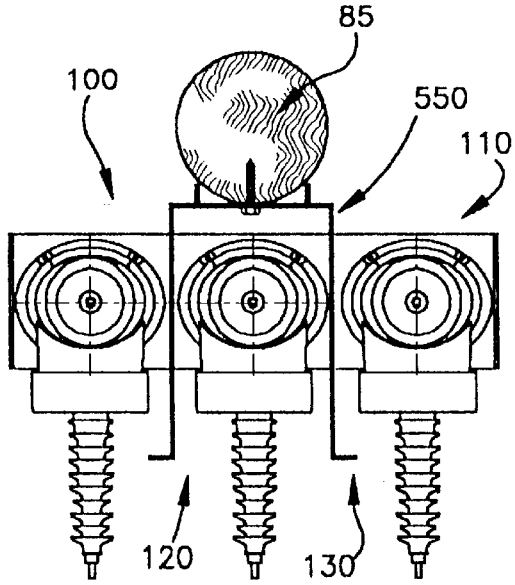
FIG. 8 is a top plan view of the recloser assembly of FIG. 3 mounted on the utility pole in a unitary configuration.
Figure 9:
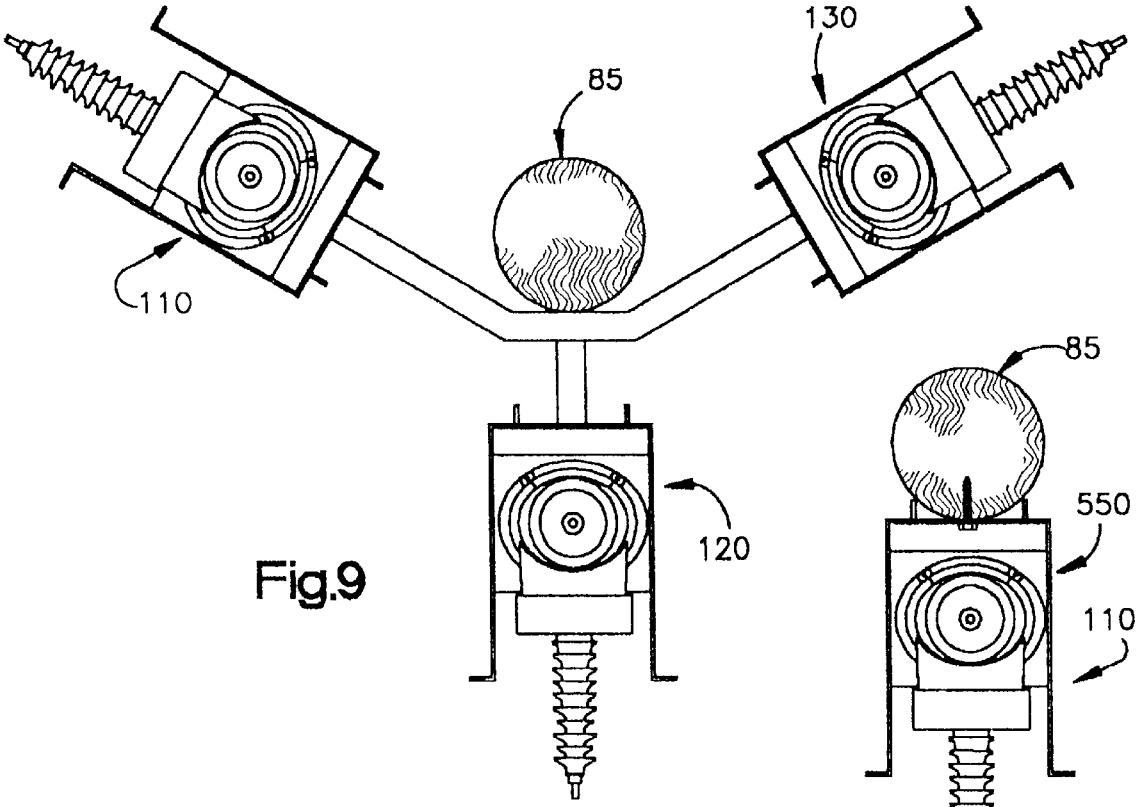
FIG. 9 is a front elevation of the recloser assembly of FIG. 3 mounted on a utility pole in a spread configuration.
Figure 10:
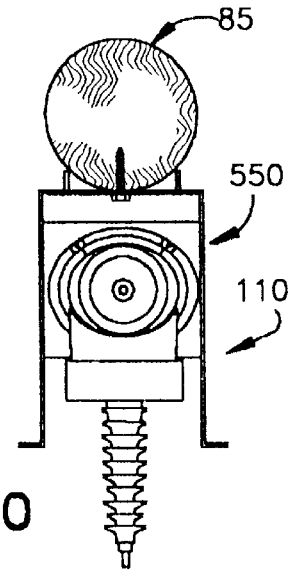
FIG. 10 is a front elevation of one recloser unit of the recloser assembly of FIG. 3 mounted on a utility pole in a stand alone configuration.

In addition to being able to operate in one phase and three phase modes of operation, there are three mounting configurations that can be advantageously be employed. A unitary mounting configuration is shown in FIGS. 7 and 8, this mounting option is suitable for the three phase mode of operation. A mounting bracket assembly 550 is utilized to affix the recloser assembly to a utility pole 85. In the single phase mode of operation, the three recloser units may be mounted in the unitary mounting configuration (FIGS. 7 and 8) (with a rigid gang rod 298 removed as will be explained below) or, alternatively, may be mounted in a spread configuration (FIG. 9) or in a stand alone configuration (FIG. 10). In the stand alone configuration, a selected one of the recloser units (for example, recloser unit 110) is mounted individually on the utility pole 85. Although not show in FIGS. 7–10, it should be understood that the recloser assembly 100 (whether operating in three phase or single phase modes of operation) and the recloser unit 110 (FIG. 10) are electrically coupled to respective suitable controllers and operate under the control of its respective controller.

Figure 19:
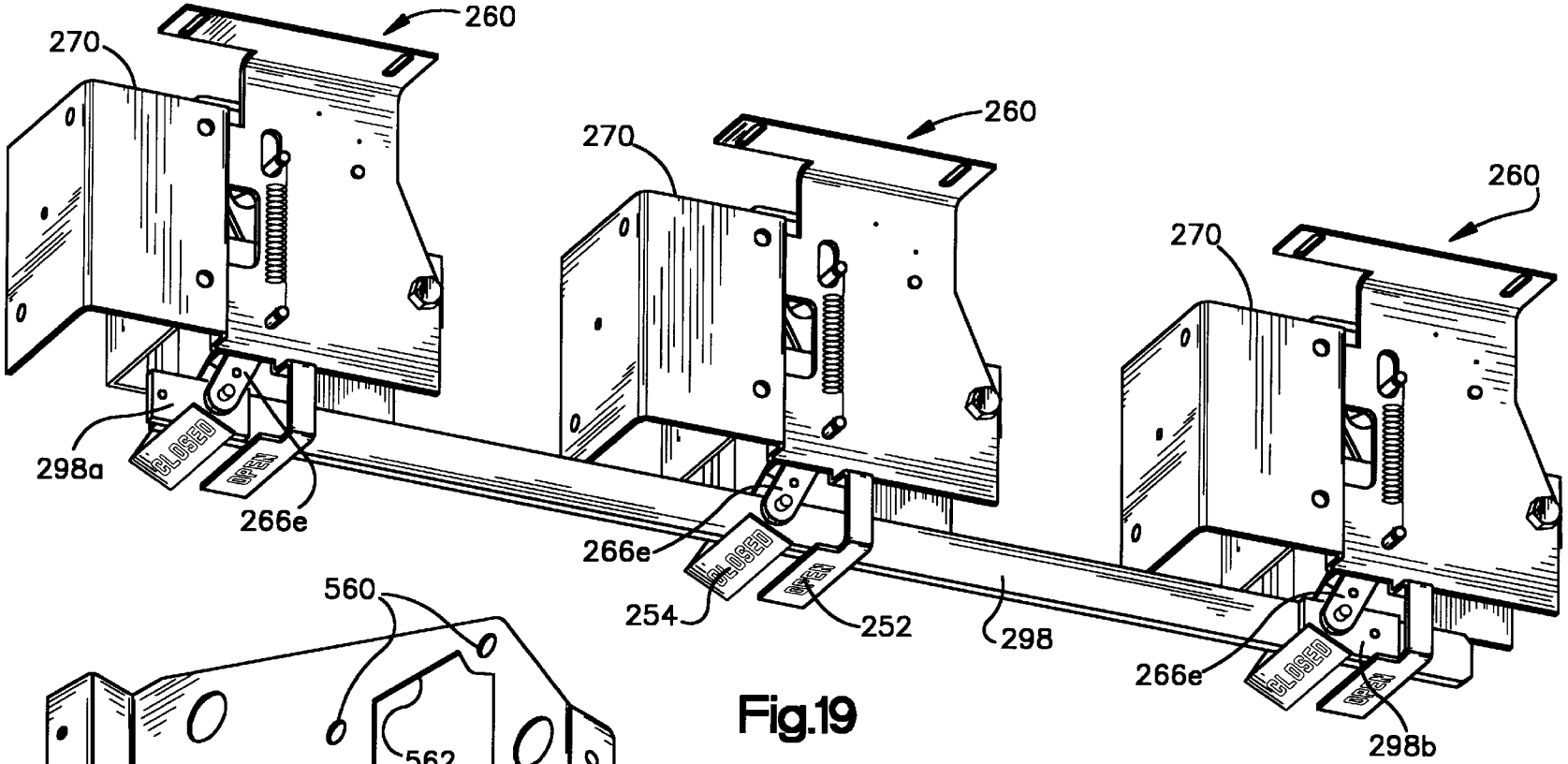
FIG. 19 is a perspective view of three solenoid switches of the recloser assembly.

In the three phase tripping mode of operation, the switching assemblies 260 of all three of the recloser units are mechanically coupled by the rigid gang rod 298 (best seen in FIGS. 5 and 19). If an overcurrent condition sensed by the controller 600 on any of the three recloser units 110, 120, 130, the controller 600 sends appropriate control signals to each of the three solenoid switching assemblies 260 causing all three recloser units 110, 120, 130 to switch to an open position. The gang rod 298 is affixed to a pivoting actuating lever 266*e* of each of the three switching assemblies 260. Thus, the pivoting actuating levers 266*e* of all three of the switching assemblies 260 are constrained to move (or not move) in unison. For example, if an overcurrent condition is sensed by the controller 600, control signals are sent to each of the switching assemblies 260 to move from their closed to their open positions. If all switching assemblies are functioning properly, all three switching assemblies would move simultaneously from their respective closed positions to their respective open positions. If, on the other hand, one of the switching assemblies was not functioning properly, e.g., one of the switching assemblies 260 does not open, the gang rod 298 insures all three switching assemblies 260 remain in their closed positions. Another control apparatus (not shown) in the power distribution system would shut down power on all three transmission lines. The function of the gang rod 298 is to prevent is a situation wherein one switching assembly is in one position and the other two switching assemblies are in the other position, resulting in transmission of one or two phase power to a customer's three phase equipment. Such one or two phase power transmission would likely cause damage to the customer's equipment.

Figure 11:
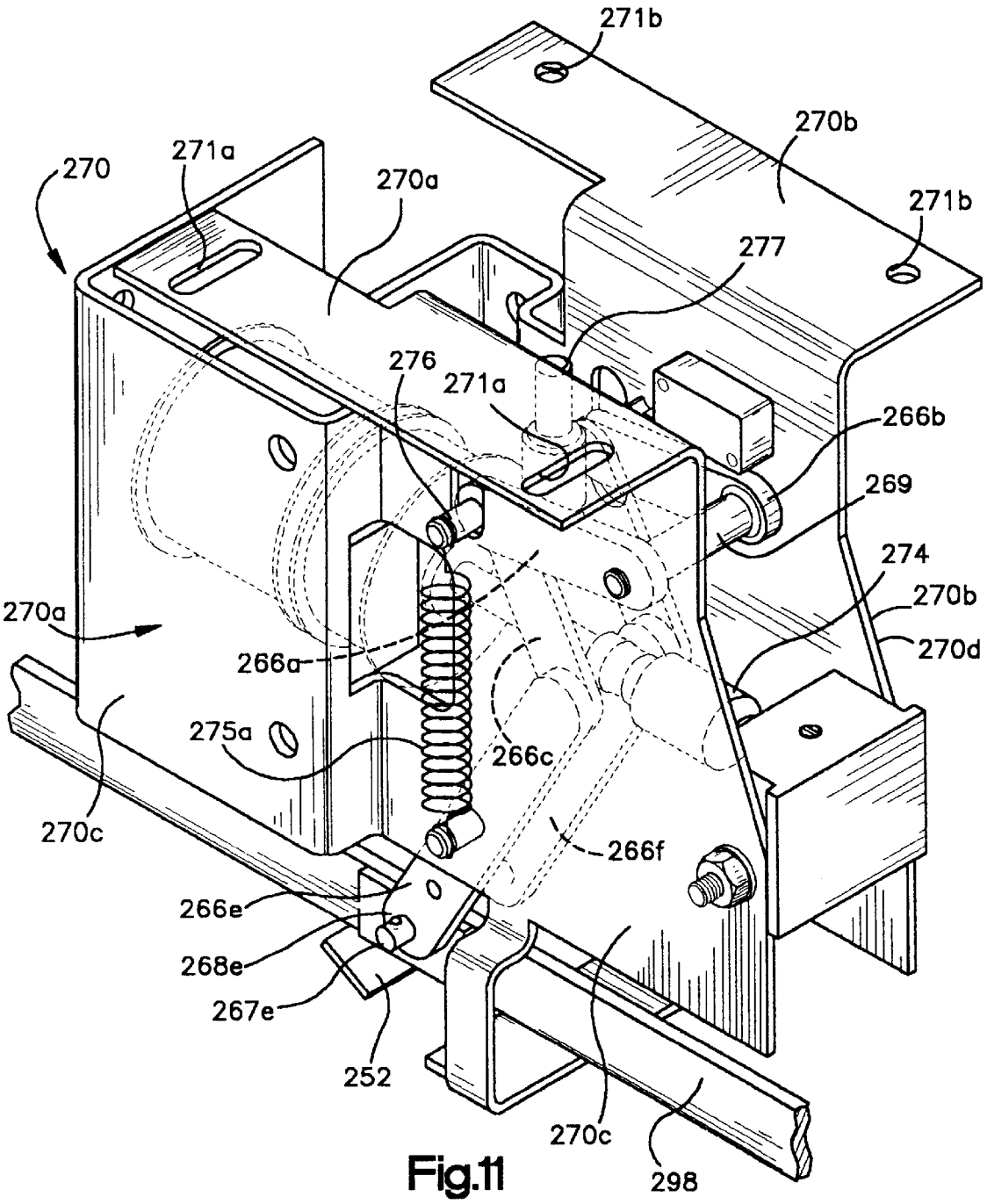
FIG. 11 is a perspective view of a solenoid switch and support of the switching assembly of the recloser unit of FIG. 6.
Figure 14:
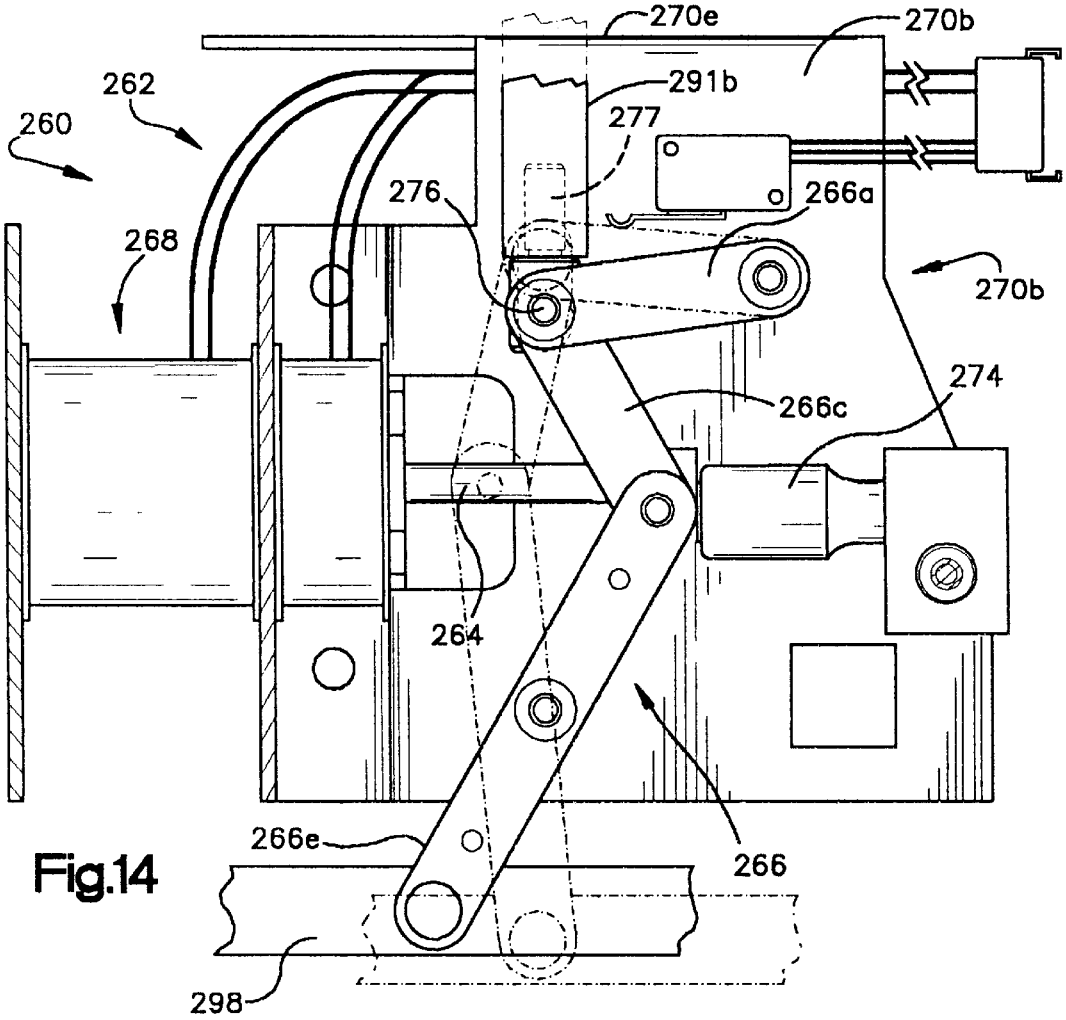
FIG. 14 is a sectional view of the solenoid switch and support of FIG. 11 as seen from a plane indicated by the line 14—14 in FIG. 13.

The simultaneous movement of all three actuating levers 266*e* (FIG. 11) from their closed positions to their open positions interrupts the three phase power distribution for period of time determined by the controller 600. This is referred to as three phase tripping because an overcurrent condition on any one of the power lines causes interruption of power on all three lines. FIG. 14 shows the pivoting actuation lever 266*e* in its open position in solid line and the lever in its closed position in dashed line. FIG. 5 shows the gang rod 298 and all three gang rod actuating levers 266*e* in their open positions.

The recloser assembly 100 can be modified to operated as three independent recloser units in a single phase operation power distribution system by removing the gang rod 298. Removing the gang rod 298 (by removing three clevis pins 267*e* that couple the gang rod 298 to the gang rod actuating levers 266*e*) eliminates the mechanical coupling between the switching assemblies 260 of the recloser units 110, 120, 130 thereby allowing the recloser units 110, 120, 130 to function independently (under the control of a suitable controller capable of serving three independent recloser units).

Figures 6, 6A:
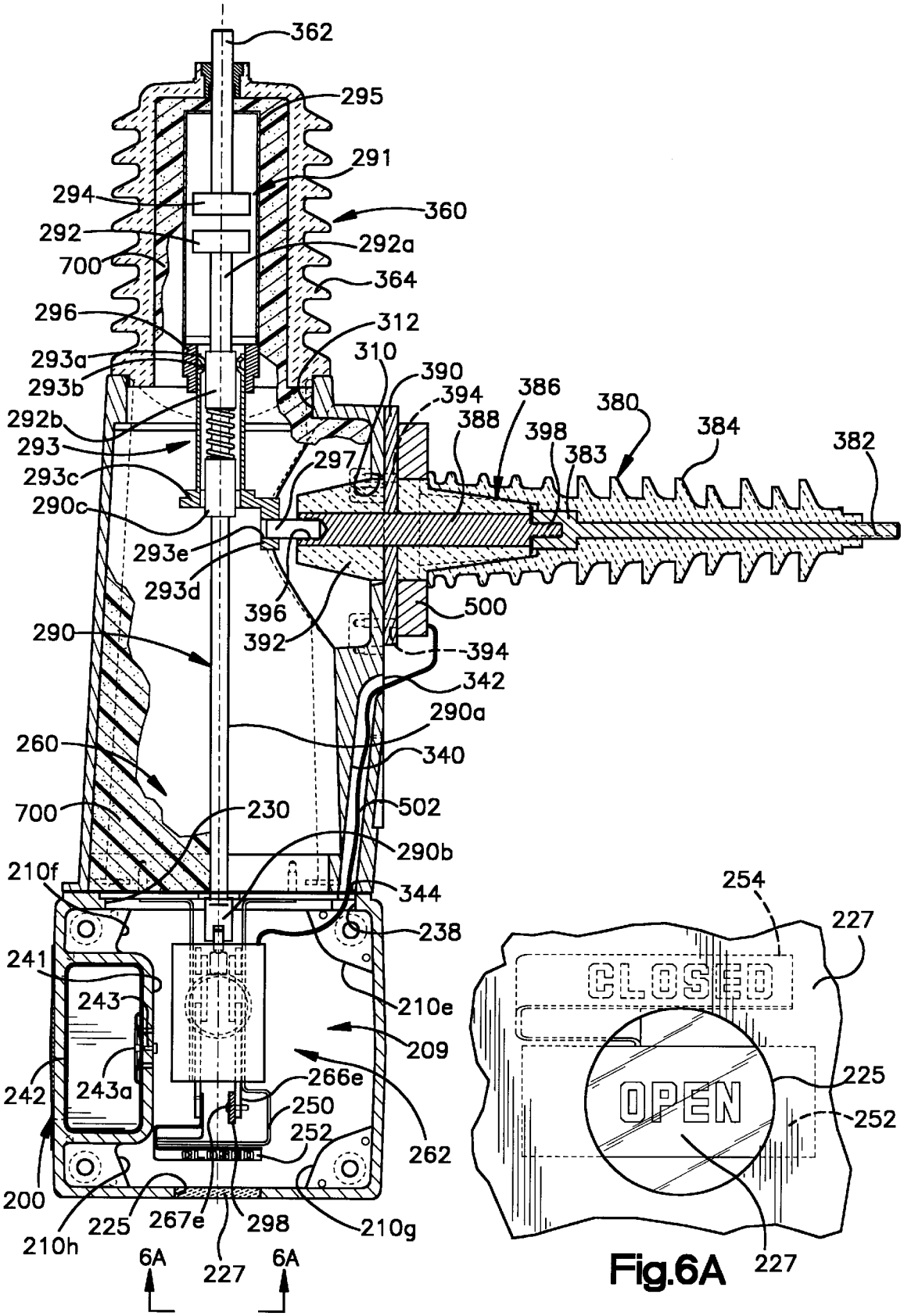
FIG. 6 is a sectional view of one of the end recloser unit of the recloser assembly of FIG. 3 with a side plate removed from a base of the recloser unit.
FIG. 6A is a bottom elevation view of a portion of the solenoid switching assembly mounted in the base of the recloser unit showing the condition of the switching assembly as seen from a plane indicated by the lines 6A—6A in FIG. 6.

As can best be seen in FIG. 6, which shows a representative one of the recloser units, each of the modular recloser units 110, 120, 130 includes a base 200, an upright support 300 affixed to the base 200, a switch terminal assembly 360 extending from an upper opening 312 in the support 300 and a line terminal assembly 380 extending from an middle opening 310 in the support. Each recloser unit is coupled in series with a different power line (not shown). The switch terminal assembly 360 includes a switch terminal 362 adapted to be connected to an end of a power line by a clamp (only one of which is shown in FIGS. 3–5). The switch terminal 362 is supported by a ceramic insulator 364. The line terminal assembly 380 includes a line terminal 382 also adapted to be connected to an end of the power line by a clamp similar to clamp 366. The line terminal 382 is mounted to a polymer insulator 384 which in turn is supported by a bushing assembly 386 affixed to the support 300. The polymer insulator 384 may alternately be fabricated of ceramic material. Preferably, the base 200 is fabricated of a rigid material and the support 300 is fabricated of a rigid material that is inherently conductive or can be coated with such a conductive material. One suitable material is cast aluminum. Since all the recloser units 110, 120, 130 are identical in design, construction and operation, the description of one recloser unit 110 will be understood to apply equally to the other recloser units.

In the recloser assembly 100 of the present invention, the recloser unit bases 200 and supports 300 are at ground potential. Each recloser unit 110, 120, 130 includes a disk shaped current transformer 500 (FIG. 6) which is part of the line terminal assembly 380. The signals from the current transformer 500 of a recloser unit is indicative of the current flow through the recloser unit. These current transformer signals are coupled to the controller 600 by a transformer wiring harness cable 502 (FIG. 6) which, in turn is coupled, to a controller cable pieces 602 and 608 (FIG. 5). The current transformer signals of all three current transformers 500 are monitored by the controller 600 to determine when an overcurrent condition exists through any of the three power transmission lines coupled to respective recloser units. If an overcurrent condition is sensed on a power line, the controller 600 sends a control signal to each of the three recloser unit switching assemblies 260 to change the state or position of the switching assemblies 260 from the closed to the open position. If the switching assemblies are ganged together by the gang rod 298 and are functioning properly, all of the switching assemblies will be switched simultaneously from the closed to the open position. Having the recloser unit bases 200 and supports 300 at ground potential is advantageous since the current transformers 500 of each recloser unit need to be at ground potential. If the bases 200 and supports 300 were not at ground potential, there would be a need for a separate line to ground for each current transformer adding additional expense and complexity to the recloser assembly 100.

Base 200 of Recloser Unit

Figure 16:
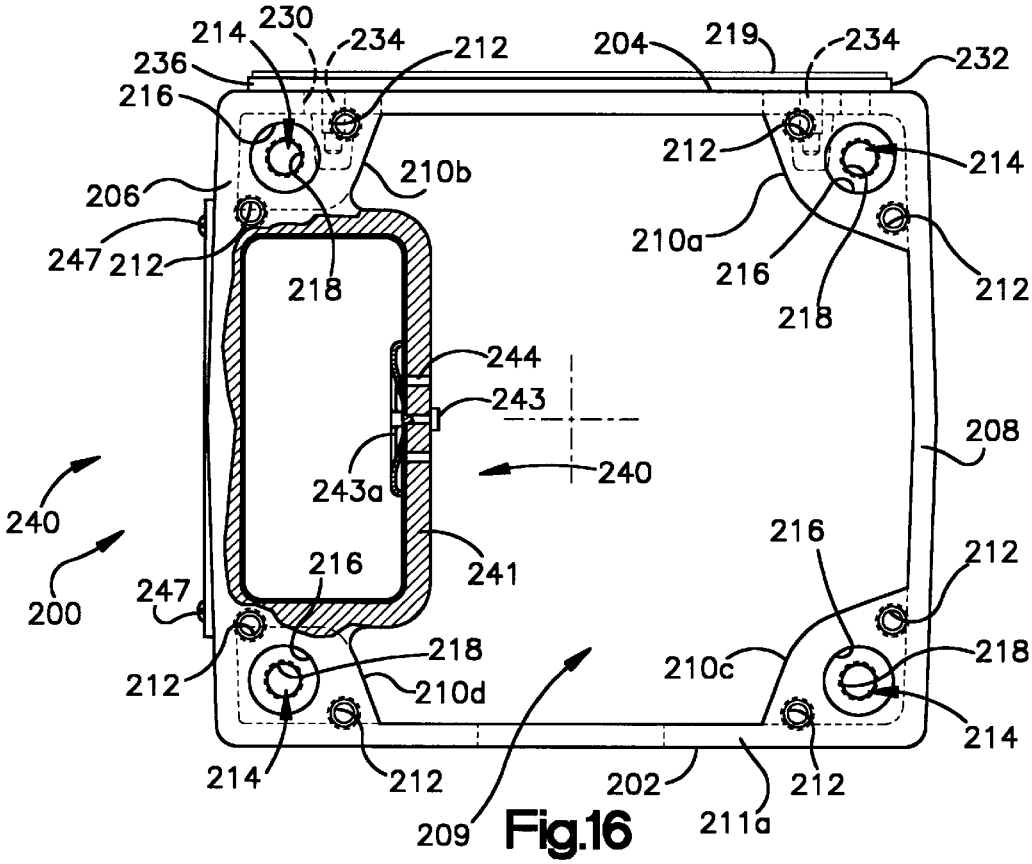
FIG. 16 is a side elevation view of the base with the solenoid switch of the switching assembly removed.
Figure 17:
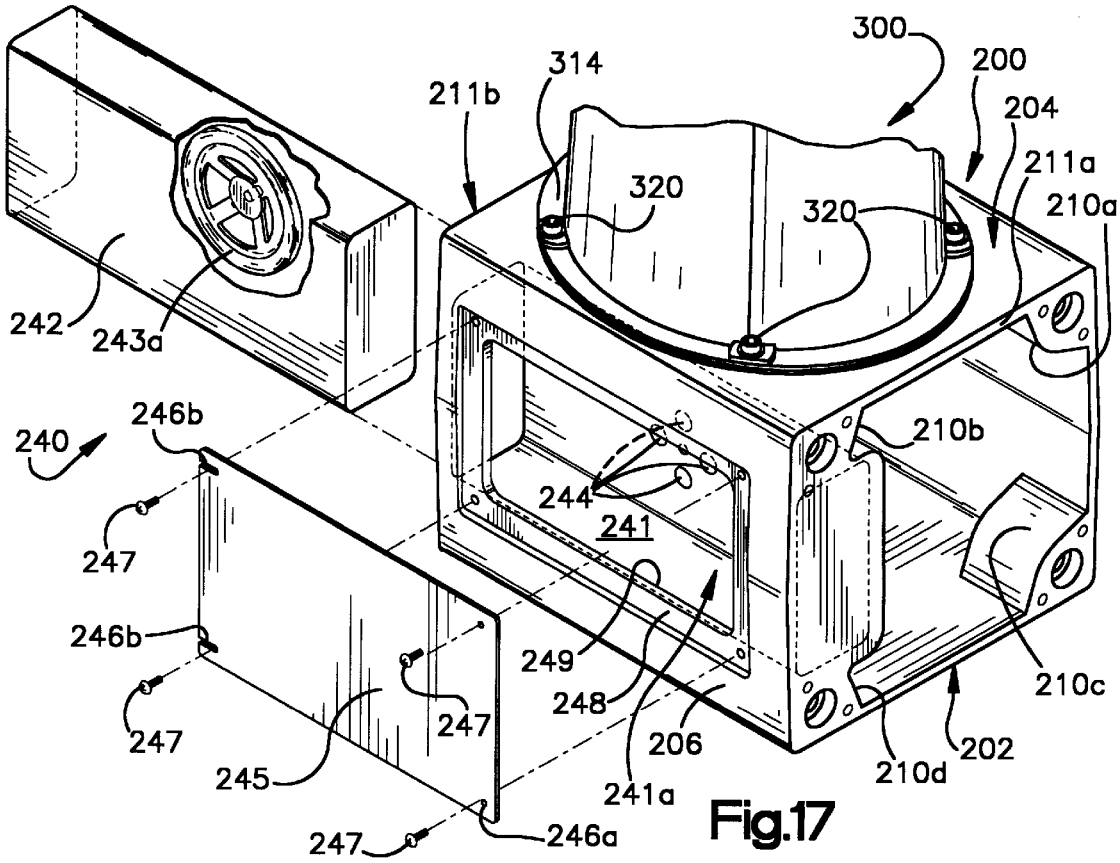
FIG. 17 is an exploded perspective view of the base with the solenoid switch of the switching assembly removed.
Figure 18:
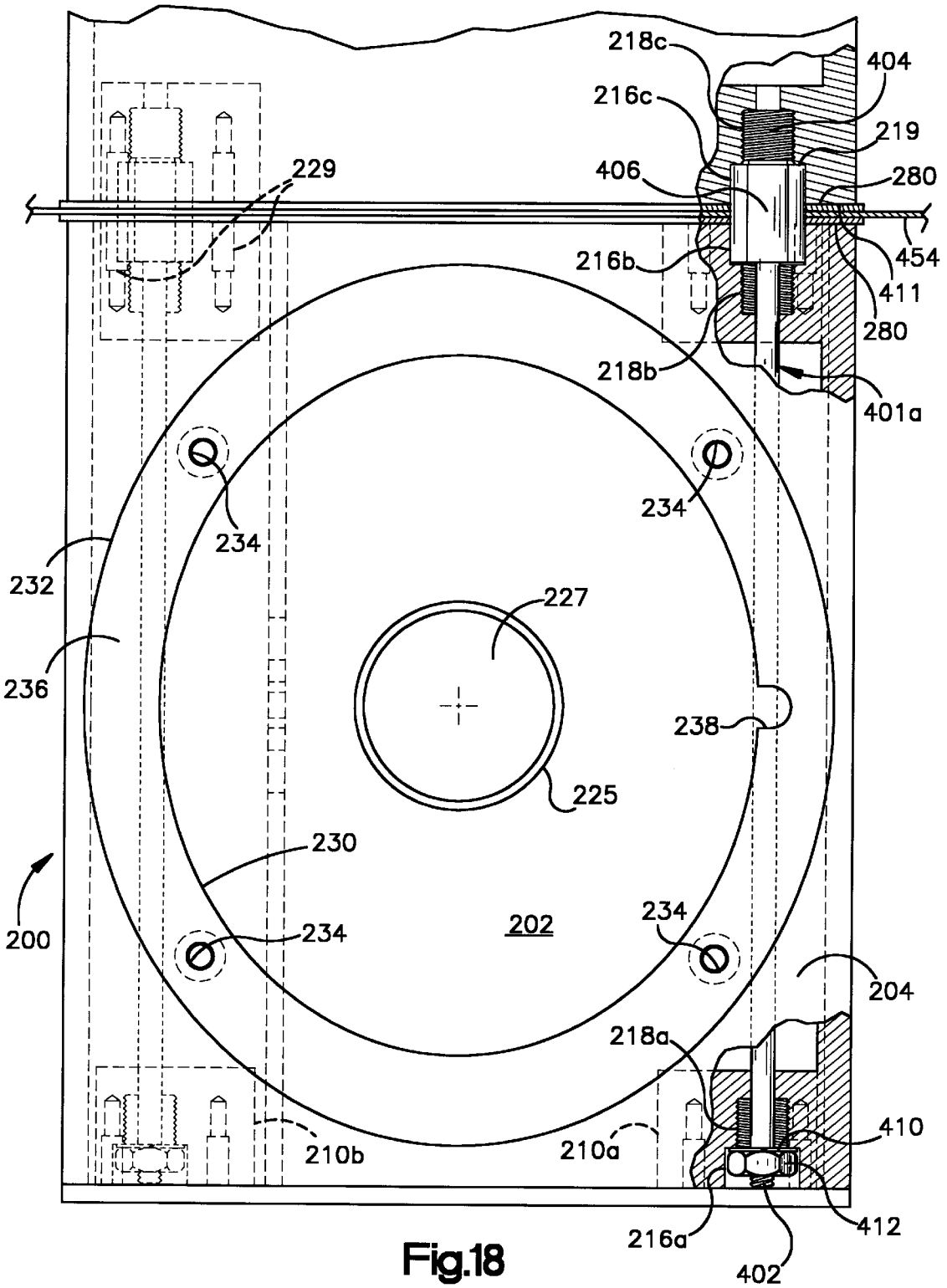
FIG. 18 is a top plan view of two of recloser unit bases coupled together by tie rods.

As can best be seen in FIGS. 16, 17 and 18, the recloser unit 110 includes a generally cubic shaped base 200 having a bottom side 202, a top side 204, a front side 206 and a back side 208. The base 200 defines an interior region 209 (FIG. 6) and the bottom side 202, the top side 204, the front side 206, and the back side 208 define a horizontal passageway or throughbore extending through the base 200. Extending inwardly at each of the eight outer corners of the base 200 are corner pieces 210*a*, 210*b*, 210*c*, 210*d*, 210*e*, 210*f*, 210*g*, 210*h* (corner pieces 210*a*, 210*b*, 210*c*, 210*d* are seen in FIG. 16, while corner pieces 210*e*, 210*f*, 210*g*, 210*h* are seen in FIG. 6) extending inwardly into the central passageway interior region 209 defined by the base 200. The corner pieces 210*a*–*h* have a radius from an outer edge of the base 200 of approximately 2 inches and a depth (in a horizontal direction) of approximately 1¼ inches from machined outer side surfaces 211*a*, 211*b*.

As can best be seen in FIG. 16, each corner piece 20*a*–*h* includes two smaller threaded apertures 212 each extending horizontally about 1 inch into the 1¼ inch depth of corner piece and a larger, centered counterbored opening 214 extending completely through the corner piece 210. The counterbored opening 214 includes an outer hole 216 having a diameter of approximately 0.94 inch terminating at a depth of 1½ inch from the outer side surfaces 211*a*, 211*b* and stepping down to a smaller ½ inch diameter threaded aperture 218 extending the remainder of the way through the corner pieces 210*a*–*h*.

The base 200 also includes a bladder compartment 241 extending into the base interior region 209. The bladder compartment 241 defines a cavity for an expandable bladder 242 (FIG. 17) and is part of a pressure equalization assembly 240 of the recloser unit 110 which functions to equalize the pressure between the base interior region 209 and the outside environment as will be explained below. Also part of the pressure equalization assembly 240 is a blow out plate 245 (FIG. 17) which is seated in a rectangular recess 248 bounding an opening 249 in the side wall 206.

Figure 12:
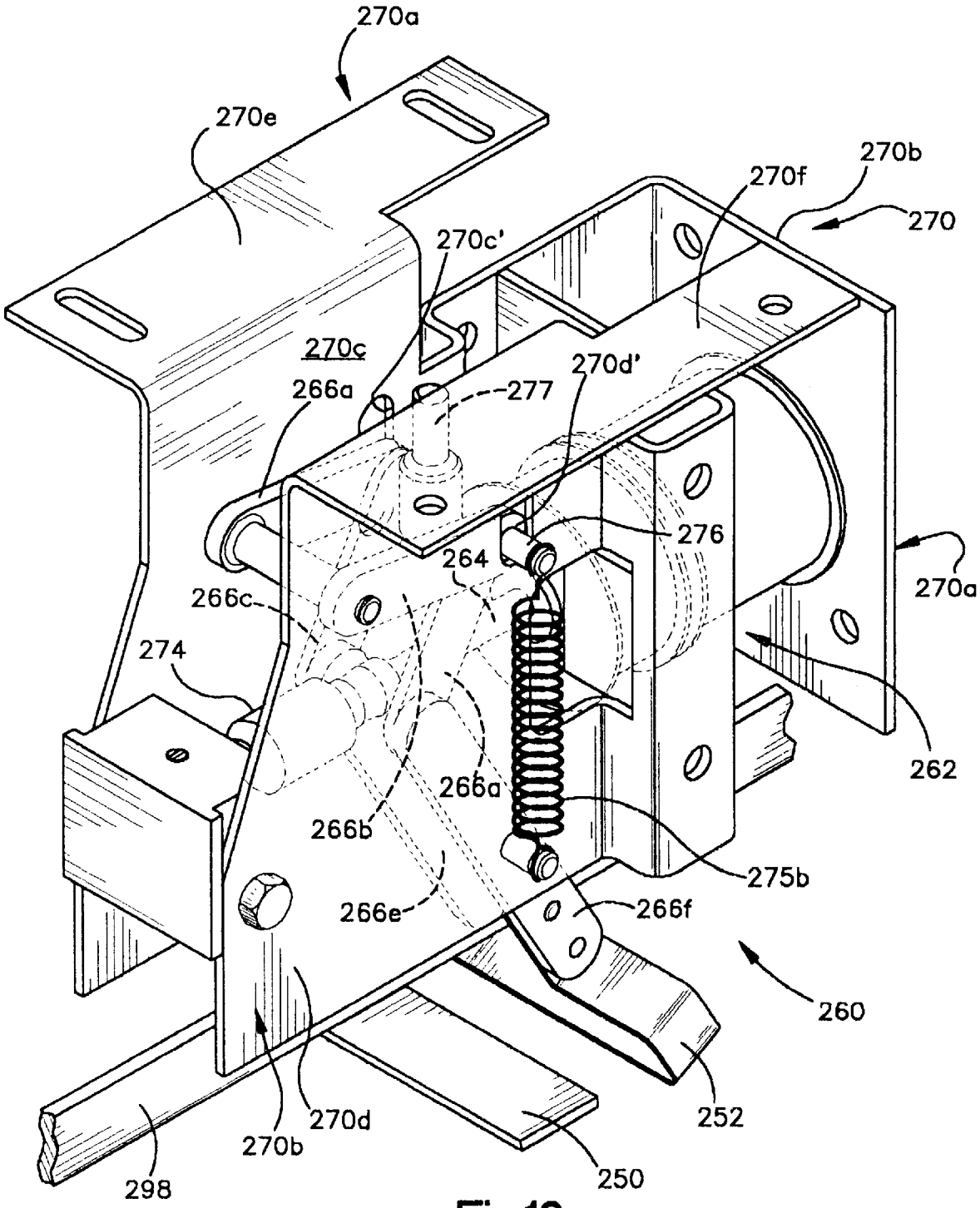
FIG. 12 is another perspective view of a solenoid switch and support of FIG. 11.
Figure 13:
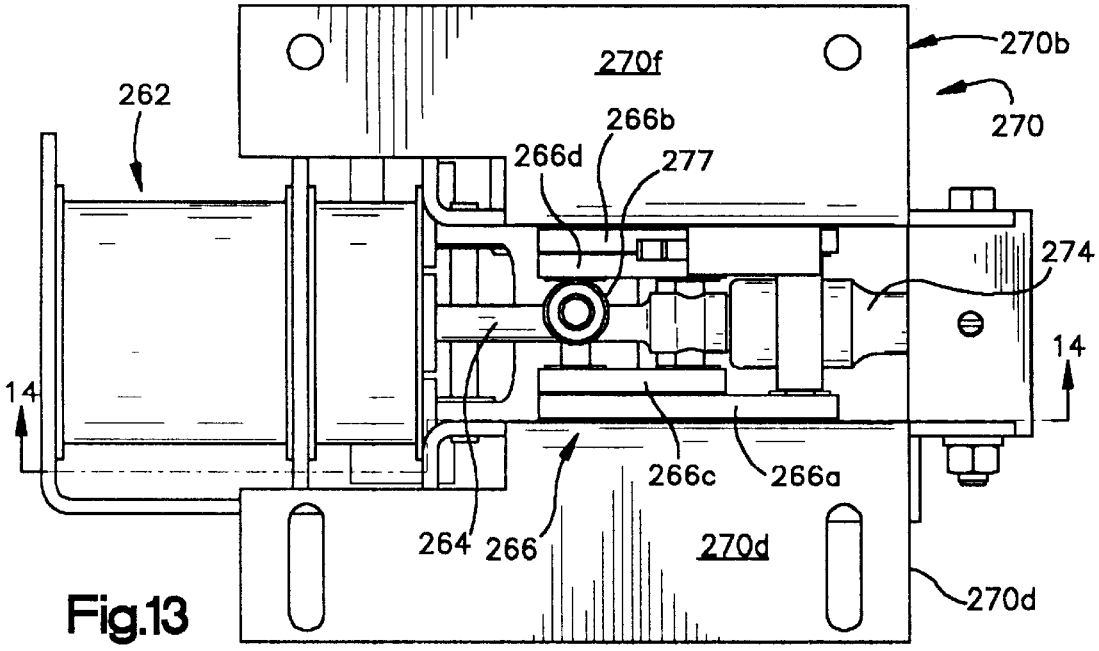
FIG. 13 is a top plan view of a solenoid switch and support of FIG. 11.

As can be seen in FIG. 6A, the bottom side 202 of the base 200 includes a circular opening 225 approximately 2¼ inches in diameter. The opening 225 is sealed with a piece of clear glass 227 thereby allowing a technician viewing the recloser unit 110 from below the unit to determine if the recloser unit switching assembly 260 is in an open or closed condition. As can be seen in FIG. 6A, if the switching assembly 260 is in the open position (no conduction between the switch terminal 362 and the line terminal 382) a stationary bracket 252, having the word "OPEN" written on it, is visible through the glass 227. A moving bracket 254, having the word "CLOSED" written on it, is attached to a pivoting actuating lever 266*f* (FIG. 12). The pivoting actuating lever 266*f* pivots in unison with gang rod actuating lever 266*e*. When the switching assembly 260 is in the closed position, the "CLOSED" bracket 254 pivots to a position overlying the "OPEN" bracket 252 so that the "CLOSED" bracket 254 is visible through the glass 227.

The top side 204 of the base 200 includes an elliptical opening 230 (FIG. 16) defined by a stepped one inch wide portion 232 extending upwardly from the upper surface of top side 204. An upper surface 236 of the stepped portion 232 is machined to a smooth, flat finish and provides a mounting surface for a mating bottom surface 314 (FIG. 8) of the support 300. The stepped portion 232 includes a notch 238 which defines part of passageway for the wiring harness 502 of a current transformer 500 supported by a bushing assembly 386 affixed to the support 300. The stepped portion 232 includes four threaded apertures 234 which receive respective ¼ inch Allen head screws 320 (three of which can be seen in FIG. 17). The Allen head screws 320 fasten the support 300 to the base 200.

Support 300 of the Recloser Unit 110

The support 300 is comprised of an elliptically shaped lower region, a middle region and a circular shaped upper region. The support 300 supports the line terminal assembly 380, the switch terminal assembly 360 and the switching assembly 260. The support lower region terminates in an outwardly extending flanged section 314 (FIG. 17) having four 0.28 inch diameter holes. A bottom surface of the flange section 314 is machined flat.

As noted above, the four ¼ inch Allen head screws 320 are threaded through aligned threaded openings in the support flange 314 and threaded openings 234 in the stepped portion 232 to mechanically couple the base 200 and the support 300. A thin gasket 219 (seen in FIG. 16), preferably made of TEFLON material, is sandwiched between the machined upper surface 236 of the base 200 and a mating bottom surface of the support 300.

The switching assembly 260 is disposed within the housing interior region 209 but is support by and extends downwardly from the support 300. A mounting bracket 270 of the switching assembly 260 is bolted to the support 300. Four ¼ inch screws pass through two apertures 271*a* (FIG. 11) in a first upper portion 270*a* of the mounting bracket 270 and two apertures 271*b* in a second upper portion 270*b* of the mounting bracket 270 and thread into four vertical holes in respective inwardly extending triangular nubs of the support lower region to secure the bracket 270 to the support 300.

The support interior region 301 (FIG. 8) is filled with polyurethane foam insulation 700 (e.g., JOSLYTE polyurethane foam) which functions as a dielectric insulating material. An operating rod assembly 290 extends upwardly from the solenoid switching assembly 260 disposed in the base 200. A vertical cylindrical opening in the insulation material 700 provides a path for the operating rod assembly 290. The insulation material 700 is injected into the support interior region 301 in semi-liquid form and then hardens into solid form as it cools. An upper portion 290*c* of the operating rod assembly 290 is pinned to a metallic conductive rod 295 which is part of a vacuum interrupter terminal contact or switch assembly 291. The rod 295, in turn, is coupled to the movable contact 292 of the vacuum interrupter assembly 291.

The switch terminal assembly 360 extends through an opening 312 in the support upper portion 306 and the line terminal assembly 380 extends through an opening 310 in the support middle portion 304. A passageway 340, separate from the support interior region 301, extends between a top opening 342 in the middle portion 304 and a bottom opening in the machined surface 318 of the lower portion 302. The passageway 340 provides a path for the wiring harness 502 extending from the current transformer 500 into the base interior region 209 where the wiring harness 502 is electrically coupled to the controller cable 602.

Mechanical Coupling Assembly 400 for Bases 200

Figure 15:
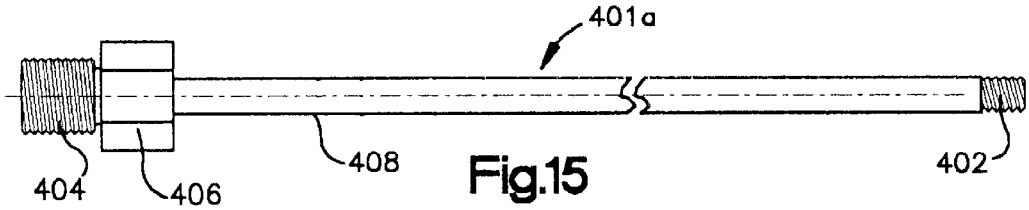
FIG. 15 a side elevation view of a tie rod used to mechanically couple the recloser unit bases together.

Turning to FIGS. 5, 15 and 19, the recloser units 110, 120, 130 are mechanically coupled by a mechanical coupling assembly 400 (shown in dashed line in FIG. 5). The mechanical coupling assembly 400 includes eight tie rods 401 (FIGS. 5 and 15). Four tie rods couple the outer recloser unit 110 and the middle recloser unit 120, while four other tie rods 400 couple the outer recloser unit 130 and the middle recloser unit 120 .

Each of the tie rods 401 are identical configuration. As can best be seen in FIG. 15 which illustrates one particular tie rod 401, the tie rod 401*a* has a threaded end 402 and an opposite end 404 having a threaded portion 406 and an enlarged distal portion 408. The large threaded end 402 of the tie rod 401*a* is threaded into the threaded ½ inch aperture 218 of the counterbored opening 214 of the center recloser unit 120. The hex portion 406 of the tie rod 401*a* enables the use of a wrench to tighten the threaded end into the opening such that the hex portion 406 is snugged against a lockwasher (not shown) sandwiched between the hex portion and the counterbore stepped surface 219. Since the hex portion 406 is 1 inch in length, approximately ½ inch of the hex portion extends outwardly beyond the side surface 411 when the hex portion is abutting the counterbore stepped surface 419 thus providing a region for the wrench to be applied to.

The base 200 of the end recloser unit 110 slides onto the four tie rods 401 and is secured to the middle recloser unit 120 by a lock washer 410 and a nut 412 that thread onto the smaller diameter threaded portion 402 of each of the four tie rods 401. The smaller threaded portion 402 has a ⅜ inch diameter and the shaft 408 has a diameter of 0.375 inches in diameter so these portions of the four tie rods 401 pass through the ½ inch inner aperture 218 of counterbored opening 214 of the outer recloser unit base 200. The same type of tie rod mechanical coupling affixes the bases 200 of outer recloser unit 130 and middle recloser unit 120.

When the three recloser units 110, 120, 130 are assembled, the horizontal central passageways 249 through each base 200 define an open region or cavity extending from an endplate 420 overlying and sealing an outwardly facing end 211*a* of the recloser unit 110 and an endplate 430 overlying and sealing an outwardly facing end 211*b* of the 10 recloser unit 130. The endplates 420, 430 are each held in place by eight ¼ inch screws that screw into aligned apertures in the endplates 420, 430 and the threaded apertures 212 in the outwardly facing corner pieces 210 of the bases of recloser units 110, 130. Sealing gaskets 282 are disposed between the end plates 420, 430 and the bases of recloser units 110 and 130.

As can best be seen in FIG. 5, the cable 602 within the base 200 that couples the controller 600 to each of the switching assemblies 260 terminates in a standard 9 pin female connector 604 supported within a sealing gasket 606. The sealing gasket is seated in a circular opening in the endplate 420. A length of cable 608 couples the controller 600 and a male connector 610 which plugs into the female connector 604.

A manual trip assembly 440 permits external manual tripping of the switching assemblies 260 from closed to open positions. The manual trip assembly 440 includes a manual lever 442 pivotable between two positions. The lever 442 is mounted on a rod 444 that extends though a sealing gasket 443. The sealing gasket 443 is seated in a counterbored opening in the endplate 430. As the rod 444 pivots between two positions, an eccentric cam contacts an end of the gang rod 298. The cam is shaped such that the movement of the gang rod 298 from a closed to an open position is rapid even if the lever 442 is moved slowly though its path of travel.

Mounting Bracket Assembly 550

Figure 20:
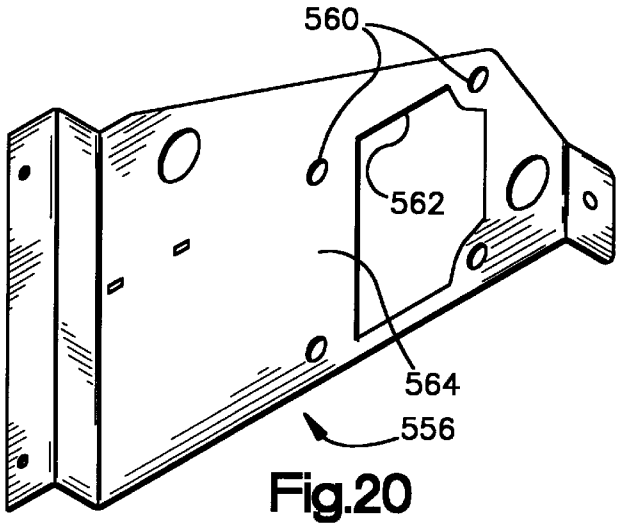
FIG. 20 is a perspective view of a forwardly extending mounting bracket of a mounting bracket assembly of the recloser assembly.

Sandwiched between the bases 200 of recloser units 110, 120, 130 is a U-shaped stainless steel mounting bracket assembly 550 suitable for mounting the recloser assembly 100 to a utility pole 85 in a unitary mounting configuration. The bracket assembly 550 includes a backplate 552 suitable for mounting to a bracket extending from a utility pole and two parallel forwardly extending brackets 554, 556, which are mirror images of each other. The backplate 552 includes a center U-shaped channel preferably having a thickness of ⅜" for structural rigidity. As can best be seen in FIG. 4, the channel includes a upper keyhole opening and a lower circular opening. As can best be seen in FIG. 20, which shows a perspective view of forwardly extending portion 556, the forwardly extending brackets 554, 556 each include four circular openings 560 aligned with the counterbored openings 214 and a central opening 562 aligned with the horizontal interior region central passageway 209 of each of the recloser units 110, 120, 130. The central passageways 209 of each of the recloser units are continuous or contiguous combining to form the horizontal passageway 414 that extends from endplate to endplate 420, 430 Two sealing gaskets 280 are sandwiched between each side of the bracket 554 and the bases of recloser units 110 and 120. Similarly, sealing gaskets 280 are sandwiched between each side of the bracket 556 and the bases of recloser units 120 and 130.

In the unitary mounting configuration, the recloser assembly 100 is "hung" on the utility pole 85 using a pair of lag bolts which screw into the utility pole 85. A first lag bolt is screwed into the utility pole, the keyhole opening of the U-shaped channel fits over the head of the lag bolt and the assembly is then lowered so the head of the lag bolt abuts the narrow upper portion of the keyhole opening. A second lag bolt is then positioned so as to extend through the lower opening in the U-shaped channel and is screwed into the utility pole. The lower opening is small enough to prevent the head of the lag bolt from coming through. The rearwardly extending portions of the backplate 552 abut the utility pole 85 to prevent rocking or movement of the mounting assembly 550 on the lag bolts. The mounting assembly 550 provides sufficient clearance between the rearwardly facing side of the base of the recloser unit 120 and the backplate 552 to permit the lag bolt to be positioned and screwed into the utility pole. Those skilled in the art will recognize that other mounting options are possible with slight modifications of the mounting assembly.

In the spread configuration, each recloser unit 110, 120, 130 has its own mounting assembly 550. As can best be seen in FIG. 9, in the spread configuration, the recloser units are mounted to respective extending arms of a utility pole bracket. Bolts are used to affix the respective U-shaped channel of the backplate 552 to the extending arms of the utility pole bracket. Other mounting options are possible as will be appreciated by those skilled in the art. Of course the spread configuration can only be used where single phase operation is desired as the gang rod 298 is necessarily removed. Also appropriate electrical cable connections from the recloser units to respective suitable controllers (the controllers being either mounted on the utility pole or supported on the ground) would be needed for operation of the recloser units.

Yet another option for the user is to use a single recloser unit in a stand-alone configuration. This option is illustrated in FIG. 10. The recloser unit 110 includes a mounting assembly 550 for mounting the recloser unit to the utility pole 85 via lag bolts similar to the unitary configuration explained above. An appropriate electrical cable connections from the recloser unit 110 to a suitable controller (either mounted on the utility pole or supported on the ground) would be needed for operation of the recloser unit.

Pressure Equalization Assembly 240

As can best be seen in FIGS. 16 and 17, the recloser unit 110 advantageously features a pressure equalization assembly 240 disposed in the base 200. The front side 208 of the base 200 is solid and the rear side 206 includes a rectangular opening 249 which opens into the bladder chamber 241. The thin aluminum blow out plate 245 is seated in a recess 248 surrounding the rectangular opening 249. The blow out plate 245 includes two apertures 246*a* and two slotted openings 246*b*. Four screws 247 affix the blow out plate 245 to the base 200. Supported within the bladder chamber interior region 241*a* is a bladder 242 comprising polyurethane film-ether grade. The bladder 242 includes an 2⅛ inch diameter central opening surrounded by a 3⅜ inch boss. A clamping plate 243*a* which extends into an interior region of the bladder 242 and a plug nut 243 secure the bladder to the bladder chamber wall 241. Openings in the clamping plate 243*a* (best seen in FIG. 17) and four holes 244 in the bladder wall 241 provide for fluid communication between the bladder interior region and the base interior region 209. End regions 220 of the base adjacent the base bladder chamber 241 are continuous or solid, thereby functioning as a solid boundary or endcap between the bladder chambers 241 of recloser units 110 and 120 and between bladder chambers 241 of recloser units 120 and 130.

The bladder interior region expands and contracts as a function of the pressure in the base interior region 209. The slots 246*b* of the blow out plate 245 permit the blow out plate to bow outwardly when the bladder interior region tries to expand beyond the bounds of the bladder chamber interior region 241*a*. In the event the pressure inside the base interior region 209 exceeds by a predetermined amount the pressure in the outside environment, the bladder 242 expands sufficiently to bow the blow out plate 245 outwardly to a degree that the edge of the plate 245 adjacent the slots 246*b* passes beyond the heads of the screws 247. In such a situation, the blow out plate 245 pivots outwardly away from the base allowing further expansion of the bladder 242 (or rupture of the bladder if expansion pressure is beyond the bladder's rupture strength) to equalize pressure between the base interior region 209 and the outside environment. Thus, the pressure equalization assembly 240 prevents catastrophic failure of the recloser assembly 100 in the event of an overpressure condition (e.g., resulting from a short circuit condition in one of the recloser units) occurring in the overall interior region 416 defined by the individual base interior regions 209.

Provision of the pressure equalization assembly is also advantageous in that the bladder 242 can contract to prevent a situation wherein the pressure of the interior region 416 is less than outside environmental pressure. Such a condition could lead to moisture from the environment being drawn into the interior region 416 and contaminating and/or shorting the switching mechanisms 260. A packet of desiccant is disposed in the base interior region 209 to absorb any moisture resulting from by condensation within the base interior region. The overall interior region 415 constitutes a closed system within a sealed unit.

Terminal Assemblies 360, 380

The switch or top terminal assembly 360 (seen in cross section in FIG. 6) includes the switch terminal 362 supported in a ceramic insulator 364. The ceramic insulator 364 is supported in the support 300 and extends through the top opening 312 of the support upper portion 306.

The line or side terminal assembly 380 includes the line terminal 382 supported in a polymer insulator 384. The insulator 384, in turn is supported by a bushing assembly 386. The bushing assembly 386 extends into the opening 310 in the middle portion 304 of the support 300 and includes a disk shaped radially extending mounting flange 390 which is secured to a flat machined surface 350 of the support 300 surrounding the opening 310 by three screws which are inserted through three spaced apart openings 394 (two of which can be seen in dashed line in FIG. 6) in the mounting flange 390 and screw into three threaded apertures 352 (FIG. 9) of the support 300. As can best be seen in FIG. 6, the bushing assembly 386 includes a 1¼ inch diameter horizontal conductive rod 388 surrounded by sections of cone-shaped hard rubber insulating material 392 extending from both sides of the mounting flange 390.

The left end (as seen in FIG. 6) of the conductive rod 388 defines a threaded female ⅝ inch diameter opening 396 which screws onto a threaded conductor 297 which, in turn, extends into a cylindrical opening 293*e* of a lower portion 293*c* of a current transfer joint 293. The right end of the conductive rod 388 includes a threaded male conductor 398 which threadedly receives a threaded female end 383 of the terminal 382 thereby attaching the insulator 384 to the bushing assembly 386. A suitable bushing assembly is part no. 67551 (shank length 2¹⁵⁄₁₆") produced by Elastimold Company, Hackettstown, N.J. 07840. The purchased bushing is slightly modified by welding an additional annular piece to the stock flange to increase the diameter of the flange.

The disk-shaped current transformer 500 is coaxially sandwiched between an end of the insulator 384*a* and the mounting flange 390. The current transformer 500 generates signals corresponding to the level of current flowing through the recloser unit. A thin aluminum cover 504 with a central opening 506 overlies the current transformer 500 and is screwed with two screws to the support 300. The cover includes an extending lower portion which overlies the wiring harness 502 and the entry hole of the support passageway 340.

The vacuum interrupter assembly 291 includes the movable contact 292 and the stationary contact 294 disposed in an evacuated ceramic casing 295. A suitable vacuum interrupter assembly is disclosed in U.S. Pat. No. 5,387,771 to Luehring issued Feb. 7, 1995, entitled "Axial Magnetic Field High Voltage Vacuum Interrupter" referenced above. The switch terminal 362 is electrically coupled to the stationary contact 294. As noted above, the metallic conductive rod 292*a* extends downwardly from the moveable contact 292.

An annular metallic ring 296 extends downwardly from a bottom portion of the casing 295. The copper current transfer joint 293 abuts the annular metallic ring 296. An upper portion 293*a* of the current transfer joint 293 is similar to a collet having eight symmetrically spaced slots extending longitudinally approximately 3 inches from an upper end of the joint. The current transfer joint 293 includes an inwardly extending semicircular protrusion 293*b* adjacent the joint upper end. The inwardly extending semicircular protrusion 293*b* presses against and makes electrical contact with a radially outwardly extending metallic collar 292*b* affixed to the conductive rod 292*a*. The collar 292*b* has a longitudinal length (approximately 1") such that the collar is in electrical contact with the semicircular protrusion 293*b* no matter whether the movable switch contact 292 is in its open position (movable switch contact 292 not in contact with the stationary switch contact 294, as shown in FIG. 6) or in its closed position (movable switch contact 292 in contact with the stationary switch contact 294). The conductive rod 292*a* is pinned to the upper metal portion 290*c* of the operating rod assembly 290.

The lower portion 293*c* of the current transfer joint 293 includes an extension 293*d* with a cylindrical opening 293*e* for accepting a short conductive rod 297. An opposite end of the conductive rod 297 screws into the center conductive rod 288 of the bushing thereby completing an electrical path from the line terminal 360 to the movable switch contact 292. A plastic cylindrical piece (not shown) fits over the current transfer joint 293 and extends between the annular metallic ring 296*a* and the lower portion 293*c* of the current transfer joint 293. The plastic piece keeps the insulation material 700 that fills in the interior region of the support 300 and the ceramic insulator 364 from entering the interior region defined by the current transfer joint 293 thus insuring good electrical contact between the semicircular protrusion 293*a* and the radially outwardly extending collar 292 of the conductive rod 292*a*.

Solenoid Switch Assembly 260

Each recloser unit 110, 120, 130 supports a vacuum-type, solenoid switch assembly 260 (FIGS. 5, 6 and 19) each connected between the switch terminal 362 and the line terminal 382 of that recloser unit. In the open condition of a switch assembly 260, the switch and line terminals 362, 382 are electrically decoupled and in the closed condition of a switch assembly 260, the switch and line terminals 362, 382 are electrically coupled.

Providing the mechanical connection between the movable switch contact rod 292*a* and the switch assembly 260 disposed in the base 200 is the operating rod assembly 290. As noted above, the movable switch contact rod 292*a* is pinned to the upper portion 290*c* of the operating rod 290. The central portion 290*a* of the operating rod assembly 290 extends vertically downwardly through the cylindrical opening in the insulation material 700 in the support 300. The lower portion 290*b* of the operating rod assembly 290 includes a threaded opening which accepts a threaded end of a collar 276 pinned to an upwardly extending rod 278 of the solenoid switch 262. The rod 278, operating rod assembly 290 and movable switch contact 292 are mechanically affixed and are moveable between first and second positions corresponding to the open and closed switch assembly conditions (as described above). In a first position of the solenoid switch rod 278 and the operating rod 290, the switch contacts 292, 294 are spaced apart causing no power to flow through the recloser unit terminals 362, 382. In the second position of the solenoid switch rod 278 and the operating rod 290, the switch contacts 292, 294 are abutting electrically coupling the terminals 362, 382 and causing power to flow through the recloser unit. The switch contacts 292, 294 are housed in the evacuated casing 296 to minimize arcing.

The position of the operating rod assembly 290 is determined by a solenoid switch 262 of the switching assembly

260. Turning to FIGS. 11–14, the solenoid switch 262 is supported by a two piece support assembly 270 which, as described earlier, is affixed to the support 300. The support assembly 270 includes two stamped metal pieces 270*a*, 270*b*. A plunger 264 of the solenoid switch 262 moves horizontally between two positions. The plunger position is determined by the magnitude of electrical current conducted through a two coil assembly 268. The electrical energization or deenergization of the coil assembly 268 is controlled by the controller 600.

As can best be seen in FIGS. 11–14, a lever assembly 266 is mechanically coupled to the plunger 264 and the gang rod 298. Ends of two spaced apart middle levers 266*c*, 266*d* are pivotally coupled to opposite sides of the plunger 264. In turn, opposite ends of the middle levers 266*c*, 266*d* are pivotally coupled to ends of two upper levers 266*a*, 266*b*. Opposite ends of the two upper levers 266*a*, 266*b* are pivotally supported on a rod 269 bridging vertical sides 270*c*, 270*d* (FIG. 11) of the support assembly 270. A rod 276 extends between and coupling upper and middle levers 266*a*, 266*b*, 266*c*, 266*d* is short shaft 277 and is confined to move only vertically by vertical slots 270*c*′, 270*d*′ in the vertical side supports 270*c*, 270*d*. Ends of the rod 276 are coupled to springs 275*a*, 275*b*. The springs 275*a*, 275*b* biased the rod 276 to the first position of the plunger 274 (open circuit condition).

A short coupling 277 is vertically supported on the rod 276. Pinned to a reduced diameter portion of the shaft 277 is the insulating portion 290*b* of the operating rod assembly 290. As can be seen in FIG. 14, horizontal movement of the plunger 264 between its first position and its second position results in vertical movement of the shaft 277 and the rod assembly 290 between their first position (shown in solid line corresponding to an open switch position) and their second position (shown in dashed line—corresponding to a closed switch position).

For three phase operation, each recloser unit switching assembly 260 is linked or ganged together by the gang rod 298 via a clevis pin arrangement so that an overcurrent condition on any one of three power transmission lines coupled to respective recloser units will cause the switch contacts 292, 294 of all three switching assemblies 260 to open. Similarly, all switching assembly contacts close together when the plungers 274 move to their second positions. Each of the clevis pins 267*e* includes a detent near a distal end of the shank. The detent is biased radially outwardly by a spring to prevent the pin from disengaging the gang rod 298. To remove a clevis pin 267*e* from the gang rod 298, the detent is pressed radially inwardly and the pin is withdrawn. Shims 298*b* and 298*b* (FIG. 19) are used to account for any dimensional variances in the recloser unit base widths. The two outer openings in the gang bar 298 are slotted account for variation in the spacing between the three gang rod actuating levers 266*e*.

If one of the recloser units 110, 120, 130 fails, the gang bar 298 is disconnected from the recloser units and removed. The tie rods 401 and tie rod end nuts and lock washers 412, 411 are removed as necessary to permit removal of the failed recloser unit from the assembly 100.

If the recloser assembly 100 is to be used in a single phase operation, the gang rod 298 is simply removed. The recloser units 110, 120, 130 then function independently, each being under the individual control of a suitable controller. As noted above, the recloser units may be mounted in a unitary or a spread configuration. In the unitary configuration, the recloser unit bases are mechanically coupled while in the spread configuration, the recloser units are mechanically uncoupled and each recloser unit is provided its own mounting assembly 550. Furthermore, if only a single recloser unit is required for a function, a selected recloser unit (with mounting assembly) may be used in the stand alone configuration. The flexibility and interchangeability of the recloser assembly 100 operating modes and mounting configurations are unique and advantageous characteristics of the present invention.

While the invention has been described herein in its currently preferred embodiment or embodiments, those skilled in the art will recognize that other modifications may be made without departing from the invention and it is intended to claim all modifications and variations as fall within the scope of the invention.

We claim:

1. A recloser assembly suitable for three phase power distribution systems comprising:

a) three interchangeable, modular recloser units, each recloser unit having a base defining an interior region and defining a throughbore through the base, a support affixed to the base and supporting a line terminal and a switch terminal having a stationary switch contact, and a switching assembly coupled to a moveable switch contact and being moveable from a first position to a second position when a signal is received indicative of an overcurrent condition on a power line coupled to the recloser assembly;

b) in the first position of the switching assembly, the moveable switch contact contacts the switch terminal stationary switch contact electrically coupling the switch terminal and the line terminal and in the second position of the switching assembly, the moveable contact is spaced apart from the switch terminal stationary switch contact; and c) the bases of the recloser units being mechanically affixed such that the throughbores of each base are connected thereby providing a passageway between the three bases, the switching assemblies of each recloser unit being mechanically linked such the switching assemblies of all three recloser units must move in unison from their respective first positions to their respective second positions and must move in unison from their respective second positions to their respective first positions, a position of each recloser unit being interchangeable with a position of either of the other two recloser units.

2. The recloser assembly of claim 1 wherein a mechanical connector is coupled to each of the switching assemblies to mechanically link the switching assemblies, the mechanical connector extending through the passageway between the three bases.

3. The recloser assembly of claim 2 wherein the mechanical connector is a rigid bar.

4. The recloser assembly of claim 1 wherein opposite sides of each of the bases are open to define the base throughbore, the bases being mechanically affixed such that adjacent recloser units have open sides of their respective bases in alignment to provide the passageway through the bases.

5. The recloser assembly of claim 4 wherein each base is generally cubic shaped.

6. The recloser assembly of claim 5 wherein the recloser unit bases are affixed to provide a linear alignment of bases such that there is a middle recloser unit sandwiched between a first end recloser unit affixed to a left side of the middle recloser unit and a second end recloser unit affixed to a right side of the middle recloser unit and a first endplate is secured to the left side recloser unit base to overlie an outwardly facing open side of the left side recloser unit base and a second endplate is secured to the right side recloser unit base to overlie an outwardly facing open side of the right side recloser unit base.

7. The recloser assembly of claim 1 wherein each of the switching assemblies further includes a solenoid switch having a plunger movable between a first and a second position and first and second levers coupled to the plunger and moveable therewith, the rigid bar being affixed to the first lever and the moveable switch contact being operatively being coupled to the second lever, wherein movement of the plunger to the first position causes the moveable switch contact to contact the stationary switch contact and movement of the plunger to the second position causes the moveable switch contact to be spaced apart from the stationary switch contact.

8. The recloser assembly of claim 7 wherein the recloser assembly further includes a controller and each recloser unit includes a current transformer, the controller being coupled to the current transformer and the solenoid switch of each recloser unit, the current transformer of a recloser unit generating signals indicative of the current flowing through the line and switch terminals of the recloser unit, the controller receiving the signals from the current transformer of each recloser unit and, if an overcurrent condition is sensed through a recloser unit, generating signals directed to the solenoid switch of the recloser unit to move each of the solenoid switch plungers from the first position to the second position.

9. The recloser assembly of claim 1 wherein the bases of the recloser units are mechanically affixed such that the throughbores of each base are in alignment.

10. The recloser assembly of claim 1 wherein for each recloser unit an operating rod operatively couples the moveable switch contact and switching assembly, the operating rod extending though an interior region of the support and the support being filled with a solid insulating material.

11. The recloser assembly of claim 1 further including a pressure equalization assembly disposed in the base of each of the recloser units, the pressure equalization assembly including an expandable bladder disposed in a chamber in the base and having an interior region in fluid communication with an interior region of the base surrounding the switching assembly, the bladder disposed in the chamber adjacent a blow off plate affixed to an exterior wall of the base and overlying an opening in the base, the blow off plate releasably affixed to the exterior wall so as to be displaced from the base exterior wall by the bladder when a pressure in the bladder interior region exceeds a predetermined magnitude.

12. The recloser assembly of claim 1 wherein the three recloser units include a middle recloser unit, a right recloser unit having its base mechanically affixed to the right side of the base of the middle recloser unit and a left recloser unit having its base mechanically affixed to the left side of the base of the middle recloser unit, the base of the right recloser unit mechanically coupled to the middle recloser unit base by a plurality of tie rods each having a first threaded end, a second threaded end and a middle shaft portion therebetween, the first threaded end being larger in diameter than the second threaded end and the middle shaft portion and being threaded into a threaded opening in left side of the middle recloser unit base, the right recloser unit base including openings aligned with the plurality of tie rods extending from the middle recloser unit base and sized to permit the right recloser unit base to slide over the tie rods and abut the middle recloser unit base, a nut being threaded onto the second threaded end of each of the plurality of tie rods and abutting respective surfaces of the right recloser unit base to secure the right recloser unit base to the middle recloser unit base.

13. The recloser assembly of claim 10 wherein the recloser assembly includes a mounting bracket assembly for mounting the recloser assembly to a utility pole, the mounting bracket assembly including a first forwardly extending portion sandwiched between the middle recloser unit base and the right recloser unit base and a second forwardly extending portion sandwiched between the middle recloser unit base and the left recloser unit base.

14. An interchangeable, modular recloser unit suitable for use in a three phase recloser assembly, the recloser unit comprising:

a) a base defining an interior region and defining a throughbore through opposite sides of the base;

b) a support affixed to the base and supporting a line terminal and a switch terminal;

c) a switching assembly operable to selectively electrically couple the line terminal and switch terminal; and d) the base including an open right side and an open left side surrounding the throughbore, the base right side adapted to be mechanically linked to a base of a first recloser unit and the base left side adapted to be mechanically linked to a base of a second recloser unit, the three recloser units when assembled functioning as a three phase recloser assembly, the base right side including a plurality of threaded openings into which threaded end portions of a first plurality of tie rods are threaded and the base left side including a plurality of threaded openings into which threaded end portions of a second plurality of tie rods are threaded, the first plurality of tie rods extending parallel outwardly from the base right side and adapted to slidingly engage and support the first recloser unit base and the second plurality of tie rods extending parallel outwardly from the base left side and adapted to slidingly engage and support the second recloser unit base.

15. The modular recloser unit of claim 14 further including a pressure equalization assembly disposed in the base including an expandable bladder disposed in a chamber in the base, the bladder having an interior exterior in fluid communication with an interior region of the base surrounding the switching assembly, the bladder disposed in the chamber adjacent a blow off plate affixed to an exterior wall of the base overlying an opening in the base, the blow off plate releasably affixed to the exterior wall so as to be displaced from the base exterior wall by the bladder when a pressure in the bladder interior region exceeds a predetermined magnitude.

16. The recloser unit of claim 14 wherein the switching assembly includes a solenoid switch affixed to a bottom portion of the support and extending into the base interior region.

17. The recloser unit of claim 14 wherein the switch terminal includes a stationary contact.

18. The recloser unit of claim 17 further including an operating rod operatively coupled to a moveable switch contact and being moveable from a first position to a second position when a signal is received indicative of an overcurrent condition on a power line coupled to the recloser unit, in the first position of the operating rod, the moveable switch contact contacts the switch terminal stationary contact electrically coupling the switch terminal and the line terminal and in the second position of the operating rod, the moveable contract is spaced apart from the switch terminal stationary contact.

19. The recloser unit of claim 18 wherein the solenoid switch includes a plunger movable between a first and a second position and first and second levers coupled to the plunger and moveable therewith, a gang bar coupled to the first lever and adapted to be coupled to solenoid switches of the other recloser units affixed to the base and the operating rod being coupled to the second lever, wherein movement of the plunger to the first position causes the operating rod to move to the first position of the operating rod and movement of the plunger to the second position causes the operating rod to move to the second position of the operating rod.

20. The recloser unit of claim 19 further including a current transformer generating signals indicative of the current flowing through the line and switch terminals of the recloser unit and a controller electrically coupled to the solenoid switch and the current transformer, if an overcurrent condition is sensed through a recloser unit by the controller, the controller generates signals causing the solenoid switch plunger to move from the second position to the first position resulting in an open circuit condition between the switch and line terminals.

21. The recloser unit of claim 18 wherein the operating rod extends though an interior region of the support and the support is filled with a solid insulating material.

22. An interchangeable, modular recloser unit suitable for use in a three phase recloser assembly, the recloser unit comprising:

a) a base defining an interior region and defining a throughbore through opposite sides of the base;

b) a support affixed to the base and supporting a line terminal and a switch terminal;

c) a switching assembly operable to selectively electrically couple and selectively electrically decouple the line terminal and the switch terminal; and d) a pressure equalization assembly disposed in the base including an expandable bladder disposed in a chamber in the base, the bladder having an interior exterior in fluid communication with an interior region of the base surrounding the switching assembly, the bladder disposed in the chamber adjacent a blow off plate affixed to an exterior wall of the base overlying an opening in the base, the blow off plate releasably affixed to the exterior wall so as to be displaced from the base exterior wall by the bladder when a pressure in the bladder interior region exceeds a predetermined magnitude.

23. The modular recloser unit of claim 22 wherein the base further includes an open right side and an open left side surrounding the throughbore, the base right side adapted to be mechanically linked to a base of a first recloser unit and the base left side adapted to be mechanically linked to a base of a second recloser unit, the three recloser units functioning as a three phase recloser assembly, the base right side including a plurality of threaded openings into which threaded end portions of a first plurality of tie rods are threaded and the base left side including a plurality of threaded openings into which threaded end portions of a second plurality of tie rods are threaded, the first plurality of tie rods extending parallel outwardly from the base right side and adapted to slidingly engage and support the first recloser unit base and the second plurality of tie rods extending parallel outwardly from the base left side and adapted to slidingly engage and support the second recloser unit base.

24. The recloser unit of claim 22 wherein the switching assembly includes a solenoid switch affixed to a bottom portion of the support and extending into the base interior region.

25. The recloser unit of claim 14 wherein the switch terminal includes a stationary contact.

26. The recloser unit of claim 23 further including a switching assembly including a rigid operating rod operatively coupled to a moveable switch contact and being moveable from a first position and a second position when a signal is received indicative of an overcurrent condition on a power line coupled to the recloser unit, in the first position of the operating rod, the moveable switch contact contacts the switch terminal stationary contact electrically coupling the switch terminal and the line terminal and in the second position of the operating rod, the moveable contract is spaced apart from the switch terminal stationary contact.

27. The recloser unit of claim 26 wherein the solenoid switch includes a plunger movable between a first and a second position and first and second levers coupled to the plunger and moveable therewith, a gang bar coupled to the first lever and adapted to be coupled to solenoid switches of the other recloser units affixed to the base and the operating bar being coupled to the second lever, wherein movement of the plunger to the first position causes the operating rod to move to the first position of the operating rod and movement of the plunger to the second position causes the operating rod to move to the second position of the operating rod.

28. The recloser unit of claim 27 further including a current transformer generating signals indicative of the current flowing through the line and switch terminals of the recloser unit and a controller electrically coupled to the solenoid switch and the current transformer, if an overcurrent condition is sensed through a recloser unit by the controller, the controller generates signals causing the solenoid switch plunger to move from the second position to the first position resulting in an open circuit condition between the switch and line terminals.

29. The recloser unit of claim 26 wherein the operating rod extends though an interior region of the support and the support is filled with a solid insulating material.

* * * * *